US006227081B1

(12) United States Patent
Bally et al.

(10) Patent No.: US 6,227,081 B1
(45) Date of Patent: May 8, 2001

(54) PLIERS WITH FORCE AUGMENTATION AND SELF-ADJUSTMENT CAPABILITY

(75) Inventors: Alexander Bally, Pittsburgh; Eric R. Colburn, Wexford, both of PA (US)

(73) Assignee: B!G Ventures, L.L.C., Pittsburgh, PA (US)

( * ) Notice: Subject to any disclaimer, the term of this patent is extended or adjusted under 35 U.S.C. 154(b) by 0 days.

(21) Appl. No.: 09/454,836

(22) Filed: Dec. 6, 1999

Related U.S. Application Data

(63) Continuation-in-part of application No. 09/373,819, filed on Aug. 13, 1999.

(51) Int. Cl.[7] ..... B25B 7/04

(52) U.S. Cl. ..... 81/389; 81/355; 81/91.1; 81/426

(58) Field of Search ..... 81/389, 91.1, 91.3, 81/355, 368, 370, 375, 426, 452, 454

(56) References Cited

U.S. PATENT DOCUMENTS

| | | | | |
|---|---|---|---|---|
| 1,639,183 | | 8/1927 | Ingram . | |
| 1,651,216 | | 11/1927 | McGill . | |
| 2,144,180 | | 1/1939 | Cruickshank . | |
| 2,694,331 | | 11/1954 | Meredith . | |
| 2,906,155 | | 9/1959 | Miller . | |
| 2,920,518 | * | 1/1960 | La Pointe | 81/370 |
| 3,232,152 | | 2/1966 | Miller . | |
| 3,306,143 | | 2/1967 | Ortman . | |
| 3,600,986 | | 8/1971 | Baldwin, Jr. . | |
| 4,353,240 | | 10/1982 | Undin et al. . | |
| 4,499,797 | | 2/1985 | Wilson . | |
| 4,662,252 | | 5/1987 | Warheit . | |
| 5,060,543 | * | 10/1991 | Warheit | 81/409 |
| 5,140,876 | | 8/1992 | Fields . | |
| 5,351,585 | | 10/1994 | Leseberg et al. . | |
| 5,427,004 | * | 6/1995 | Monaco | 81/91.3 |
| 5,609,080 | * | 3/1997 | Flavigny | 81/368 |
| 5,832,793 | | 11/1998 | Collins . | |
| 5,992,273 | * | 11/1999 | Galea | 81/368 |
| 6,012,361 | | 1/2000 | Wooster, Jr. et al. . | |
| 6,012,362 | | 1/2000 | Wang . | |
| 6,026,716 | | 2/2000 | Orlosky . | |
| 6,065,376 | * | 3/2000 | Khachatoorian | 81/407 |

FOREIGN PATENT DOCUMENTS 2713124 11/1993 (FR) .

* cited by examiner

*Primary Examiner*—James G. Smith
*Assistant Examiner*—Hadi Shakeri
(74) *Attorney, Agent, or Firm*—Arnold B. Silverman; David C. Jenkins; Eckert Seamans Cherin & Mellott, LLC

(57) ABSTRACT

Pliers with self-adjustment capability for applying a grasping force to a workpiece and for augmenting the grasping force applied to the workpiece which include a first plier member, a second plier member, a first pivot, a second pivot and a first biasing spring. The first plier member includes a handle portion, a jaw portion, an intermediate portion, a coupling interconnecting the handle portion of the first plier member to the intermediate portion of the first plier member, and locking device. The second plier member includes a handle portion, a jaw portion, and an intermediate portion disposed therebetween. The first pivot includes a shifting slot portion, a transitional portion, and a positioning slot portion with a generally arcuate portion formed in said intermediate portion of the first plier member. The first pivot also includes at least one pivot member extending into, and movable within, the shifting slot portion, transitional portion, and positioning slot portion. The first pivot permits the jaw portions to converge in response to movement of the handle portions toward each other for self-adjusting the jaws to the workpiece and applying the grasping force. The second pivot is defined by said locking device interacting with the second plier member. The first biasing spring acts in cooperation with the first pivot member for applying the grasping force to the workpiece and with the second pivot for augmenting the grasping force applied to the workpiece.

33 Claims, 23 Drawing Sheets

PLIERS WITH FORCE AUGMENTATION AND SELF-ADJUSTMENT CAPABILITY

CROSS REFERENCE TO RELATED APPLICATION

This application is a Continuation-in-Part of U.S. patent application Ser. No. 09/373,819, filed Aug. 13, 1999.

BACKGROUND OF THE INVENTION

1. Field of the Invention

The present invention relates generally to utility pliers and, more particularly, to pliers that self-adjust for applying a grasping force to a workpiece and for augmenting the grasping force applied to the workpiece.

2. Description of the Prior Art

Many types of handheld utility pliers are known in the art. Conventional pliers typically include two plier members interconnected in a scissors-like arrangement allowing for a workpiece to be grasped and compressed by jaw portions of the pliers in response to movement of handle portions of the pliers. Over the years, numerous improvements have been made to the conventional plier design in order to obtain better and more efficient pliers. For example, self-adjusting pliers have been developed in order to provide a set of pliers that more easily and automatically adjust to the size of a given workpiece. However, while such pliers provide adjustment capability, they do not provide active augmentation of clamping force beyond what conventional pliers provide.

A limitation of conventional plier designs is that there is an absolute limit to how close the pivot point can be moved toward the jaws, which also limits the amount of mechanical advantage a user has for applying force to a workpiece. Furthermore, in conventional pliers the handles and jaws are coupled in a fixed relationship, typically using the scissors-like arrangement as described, such that the jaws converge on a workpiece at essentially the same rate as the handles when a user applies hand pressure to the pliers. This type of fixed relationship between the handles, the jaws and the pivot point limits the amount of force that a user can apply to a workpiece and produces an undesirable trade-off between overall handle separation and gripping force being applied to a workpiece. Specifically, the longer the handles the greater the leverage and hence the greater the gripping force that can be applied to the workpiece. However, longer handles are impractical and make use of the pliers more inconvenient because either the handles are too far apart to be conveniently grasped by one hand or, if they are conventionally spaced, the resulting jaw opening is small and limits the range of adjustability of the jaws.

U.S. Pat. No. 5,832,793 discloses an adjustable wrench having a movable handle and a movable jaw for adjusting the wrench to grip objects of various sizes. While this wrench provides some degree of increased mechanical advantage as well as adjustability for grasping variously-sized workpieces, size adjustment is not automatic and requires discrete manipulations using two hands.

U.S. Pat. No. 2,144,180 discloses adjustable pliers where the handles and jaws are arranged other than in the typical scissors-like arrangement. While these pliers do allow for a level of size adjustment, the function is not provided in a seamless, one-handed operation. These particular pliers require a user to re-position his hand for each step of operation.

Many other types of pliers having handles and jaws coupled in a fixed relationship that limits the amount of force that a user can apply to an object are known. For example, U.S. Pat. No. 4,651,598 discloses utility pliers that provide for self-adjustment through employment of a spring-biased control arm positioned between the handles. In this particular hand tool the range of size adjustability within the envelope of acceptable handle spacing is limited because a large portion of the available handle movement is taken up with moving the jaws up against the workpiece from the fully open rest position. This leaves only a minor portion of available handle movement for carrying out the crucial task of workpiece compression. In addition, U.S. Pat. Nos. 3,232,152, 2,906,155 and 1,651,216 disclose adjustable pliers which utilize the concept of shifting pivot points between first and second pivot means positioned at different locations on the pliers. However, these pliers do not include a self-opening feature using spring-biased handles and jaws.

U.S. Pat. No. 5,609,080 discloses another type of pliers which is similar to the well known VISE-GRIP type pliers. Such pliers are typically not considered self-adjusting because they must be initially adjusted to set the opening of the jaws in relation to the workpiece to be grasped.

Other types of pliers are disclosed in U.S. Pat. Nos. 2,375,082, 3,091,841, and 1,639,183. U.S. Pat. No. 2,375,082 provides an adjustable wrench. However, it doesn't provide automatic self-adjustment to the size of a workpiece, nor is it usable with one hand. U.S. Pat. No. 3,091,841 uses a variable leverage linkage between the handles which drives the pivot point toward the jaws when grasping a workpiece. However, this is intended to facilitate expanding snap rings and doesn't provide for force augmentation. The continuous pivot adjustment of these pliers provides variable rate of handle movement compared to jaw movement. However, this is not a two stage approach that provides quick self-adjustment and powerful clamping. U.S. Pat. No. 1,639,183 discloses self-adjusting pliers with no biasing means to move the handles and jaws apart. In addition, while it also relies on two shifting pivots, the two pivot pins are on the same plier member, and the two openings in which the pivot pins move are on the other plier member. These pliers provide no force augmentation above that provided by conventional pliers with a conventional pivot located close to the jaws.

French Patent 2,731,124 discloses self adjustable pliers which utilize a locking mechanism derived from Vise Grip pliers. Like Vise Grip pliers, the hand force applied to the workpiece by the jaws is not linear and proportional to the force being applied to the handles. The force delivered by the jaws ramps up until it peaks as the toggle mechanism moves over center. Also, these pliers don't provide small handle excursion during self-adjustment and large handle excursion during force application. Thus, when these pliers are sized for locking onto large workpieces, they are not particularly easy to grasp by a user with small hands.

There remains a need for improved handheld utility pliers which (1) boost worker safety and productivity by actively augmenting a user's hand strength to lessen the effort and strain of compressing a workpiece, (2) which self-adjust to various workpiece sizes, (3) which provide the capability of applying a greater force to an object being gripped by the pliers, (4) which provide more responsive and precise operation, (5) which can be easily operated by the user, preferably with one hand, and (6) which feature an auditory indication of proper functioning.

SUMMARY OF THE INVENTION

The present invention has met the above-described needs by providing for improved pliers with force augmentation and self-adjustment capability, an auditory indication of proper operation and jaws that do not shift against each other when closing on a workpiece.

Pliers with self-adjustment capability that can rapidly close on a workpiece and augment the grasping force applied to the workpiece include a first plier member and a second plier member. The first plier member includes a handle portion, a jaw portion, an intermediate portion, and a link member interconnecting the handle portion of the first plier member to the intermediate portion of the first plier member, and a rack engaging structure, such as a pawl. Also provided is a second plier member having a handle portion, a jaw portion, an intermediate portion therebetween, and a generally arcuate rack formed on the intermediate portion thereof.

The pliers include a first pivot preferably having a two-part, and preferably "dog-leg," slot as described herein. The dog-leg slot includes a positioning slot with a generally arcuate portion, a shifting slot portion, and a transitional portion joining the positioning slot portion and the shifting slot. The dog-leg slot is formed in the intermediate portion of the first plier member and a pivot member is formed on the second plier member where the pivot member is movable within the dog-leg slot. As described herein, the first pivot permits the rack engaging structure to shift into soft engagement with the rack during preparatory handle movement, and also permits the jaw portions to converge in response to the third stage movement of the handle portions toward each other for moving the jaws into position against the workpiece.

The gripping of a workpiece occurs in multiple stages. While the pliers are in the first stage, i.e. fully open and at rest position, the rack engaging structure is out of engagement with the locking surfaces of the generally arcuate rack. The second stage occurs when, in response to a user holding the pliers with only light pressure against the handles, the handle portions begin to converge causing a first pivot member to shift from the shifting slot portion into the transitional portion of the dog-leg shaped slot causing the rack engaging structure to shift into soft engagement, as described herein, with the locking surfaces of the generally arcuate rack. This engagement of locking surfaces in response to preparatory handle movement takes place in a pre-determined shifting area without requiring convergence of the jaws from their fully open position.

In the third stage, as the handle members continue being drawn towards each other, the rack engaging structure remains in soft engagement with the locking surfaces of the generally arcuate rack while the jaw portions converge on the workpiece. In the fourth stage, the jaw portions have self-adjusted to the size of the workpiece and, during the continued movement of the handle portions toward each other, the rack engaging structure enters hard engagement, as described herein, with the locking surfaces of the generally arcuate rack enabling an augmented grasping force to be applied to the workpiece.

The pliers further include a second pivot defined by locking surfaces formed on a generally arcuate rack connected to the second plier member and a rack engaging structure connected to the first plier member. The second pivot permits further convergence of the jaw portions in response to continued movement of the handle portions toward each other for augmenting the grasping force applied to the workpiece.

The pliers further include a first biasing means structured to bias the first pivot member from the arcuate portion of the dog-leg slot toward the transitional area, against a user's hand pressure as the handle portions continue to converge in the fourth stage in order to apply the augmented grasping force to the workpiece, as will be explained in detail later herein.

The pliers also include a second biasing means, such as a handle spring, for biasing the handle portions away from each other and the jaw portions away from each other. The second biasing means is also structured to bias the first pivot member toward the shifting slot portion of the dog-leg slot when the pliers are in the first stage, fully open position. Furthermore, the second biasing means also causes the pliers to return to the first stage, fully open position, and the first pivot member to its initial rest position in the shifting slot, when pressure on the handles is released after use of the pliers. During the second stage, when a user initially holds the pliers with only light pressure on the handles, the second biasing means offers enough resistance to make the pliers feel responsive in the hand.

Advantageously, the described structure of the pliers of the invention is such that angular displacement of the handle portion of the first plier member is smaller than angular displacement of the jaw portion of the first plier member during the third stage movement of the handle portions toward each other while, in the fourth stage, angular displacement of the handle portion of the first plier member is larger than angular displacement of the jaw portion of the first plier member to permit the augmenting of the grasping force during the continued movement of the handle portions toward each other. Advantageously, this arrangement allows for augmenting of the grasping force that is applied to the workpiece.

In another preferred embodiment, the attachment point pivotally connecting the link member to the intermediate portion of the first plier member may be located adjacent to or spaced from the transitional area. The closer the attachment point to the first pivot, the greater the angular displacement of the jaw as compared to the angular displacement of the handle during the third stage. Thus, in Stage 3, a user can move the jaws into contact with a workpiece with a reduced amount of handle movement. However, this requires that he or she apply an increased amount of force to the handles. Thus, by increasing the proximity of the attachment point of the link member to the transitional area, less handle movement is required for the self adjustment task, leaving the handles spaced apart by a greater distance after self-adjusting to the size of a workpiece and enabling this greater handle separation to be exploited to increase the force augmentation to be applied to a workpiece. Alternatively, instead of providing more force augmentation for a pliers with conventionally spaced-apart handles, controlling the spacing of the link member attachment point to the transitional portion makes it possible to provide pliers with more closely spaced handles in order to accommodate users with limited gripping strength or hand span, yet, at the same time, also offer a full range of self-adjustability with a degree of force augmentation.

In another embodiment of the pliers of the invention, the first plier member includes a handle portion. a jaw portion, an intermediate portion, wherein the handle portion of the first plier member is formed separately from the intermediate portion of the first plier member and includes an integrally formed extension having a cam slot for cooperating with a cam follower formed on the intermediate portion of the first plier member. Preferably, the cam follower is formed on the intermediate portion of the first plier member adjacent the transitional portion of the dog-leg slot.

In another embodiment, the generally arcuate rack which forms the second pivot is formed of two, or more, laminations of metal. There are practical limits to the tooth size, or "pitch," that can be formed inexpensively using conventional manufacturing techniques. With multiple laminations, each lamination of metal includes a plurality of teeth which cooperate with the rack engaging structure to form the second pivot. The teeth of each lamination of the generally arcuate rack may be slightly offset from the teeth of the other, preferably by dividing the tooth pitch into the number of laminations, e.g. 2 laminations with ½ tooth offset, 3 laminations with ⅓ tooth offset, etc. When so structured, the generally arcuate rack in effect has a finer tooth pitch while utilizing individual laminations with the course tooth spacing that can be more easily produced using conventional manufacturing methods. Additionally, the rack engaging structure, typically a pawl biased against the rack by a leaf spring, may also be separated into two, or more, laminations corresponding to the number of offset rack laminations. Each lamination of the pawl may have its own leaf spring, or a finger of a common leaf spring, to bias the pawl lamination against its corresponding rack lamination. In an other embodiment, finer effective tooth spacing is achieved by offsetting the tooth placement on each of several pawl laminations against each other by a fraction of the rack tooth spacing such that each of the different pawl laminations alternatingly engage the rack.

It is, therefore, an object of the present invention to provide pliers for grasping workpieces of different sizes.

It is also an object of the present invention to provide pliers which have enhanced mechanical advantage.

It is another object of the present invention to provide pliers that lessen the effort and strain on a worker's hand and thereby improve his or her safety and productivity.

It is a further object of the present invention to provide pliers that can be easily and efficiently operated.

It is yet another object of the present invention to provide pliers that can be operated with one hand.

It is another object of the present invention to provide pliers with force augmentation and self-adjustment capability that are capable of augmenting the grasping force applied to the workpiece.

It is still yet another object of the present invention to provide pliers where the handles and jaws of the pliers are coupled in such a manner that angular displacement of the handles is smaller than angular displacement of the jaws during initial movement of the handle portions toward each other as the jaws self-adjust to the workpiece, and wherein angular displacement of the handles is larger than angular displacement of the jaws to permit augmenting of the grasping force during continued movement of the handle portions toward each other.

It is still another object of the present invention to provide pliers that offer an auditory indication of pawl engagement as the pliers self-adjust to initially grasp a workpiece.

It is still another object of the present invention to provide pliers that provide further reduced handle movement during self-adjustment so that a greater portion of the range of handle movement can be utilized for applying the augmented grasping force on the workpiece.

It is still another object of the present invention to provide pliers that avoid mis-aligning a workpiece as the jaws grasp a workpiece by preventing the jaws from shifting against each other as a workpiece is being grasped.

It is still another object of the present invention to provide pliers that minimize bind-up of pawl teeth against rack teeth.

It is still another object of the present invention to provide self-adjusting pliers that have significantly less handle separation in the fully open rest position without sacrificing the range of adjustability, and are therefore easier to hold and operate by users with hand impairment.

These and other objects of the invention will be more fully understood from the following description of the invention with reference to the drawings appended hereto.

DESCRIPTION OF THE PREFERRED EMBODIMENT

Figure 1:
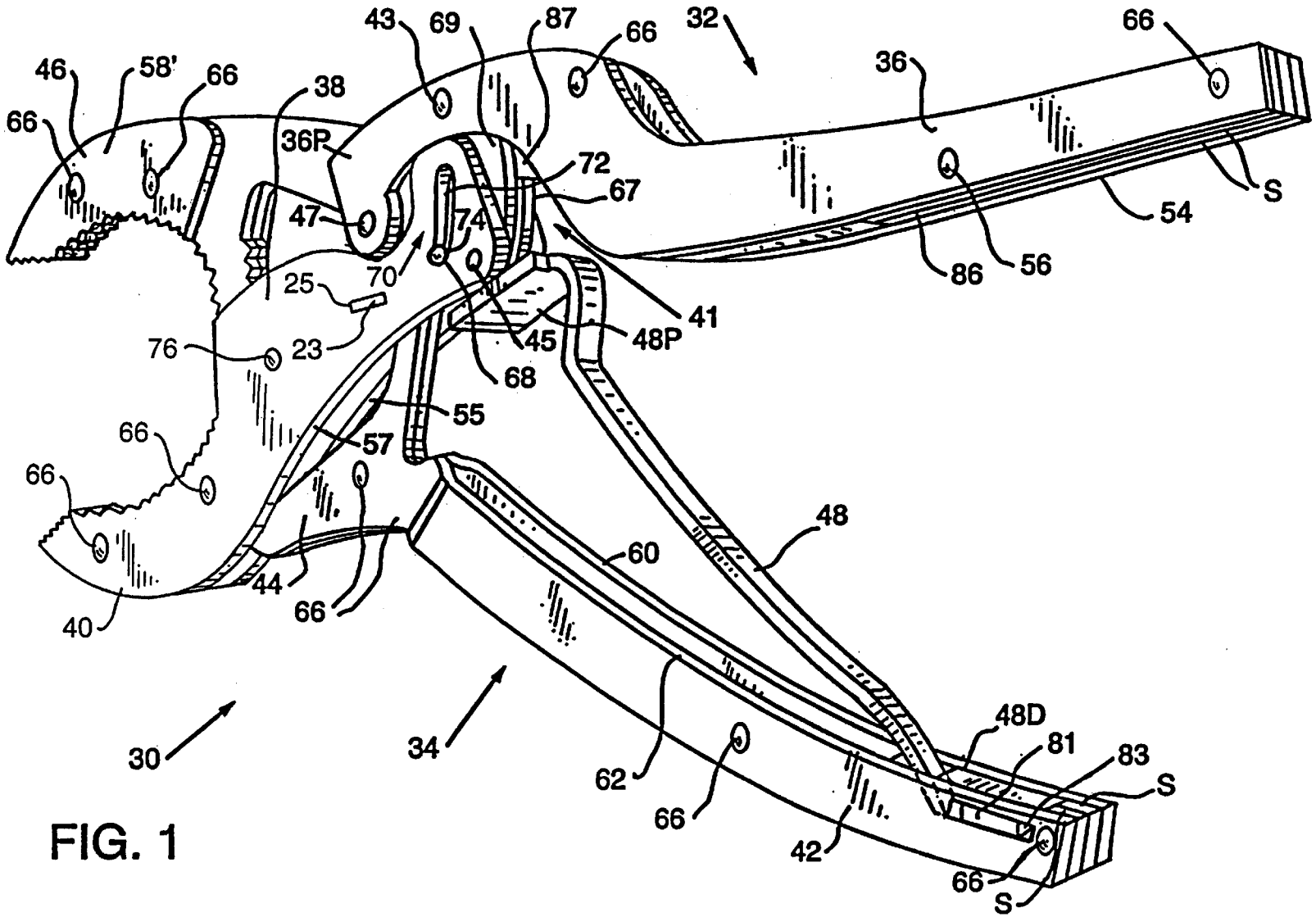
FIG. 1 is a perspective view of a preferred embodiment of the pliers of the present invention.
Figure 2:
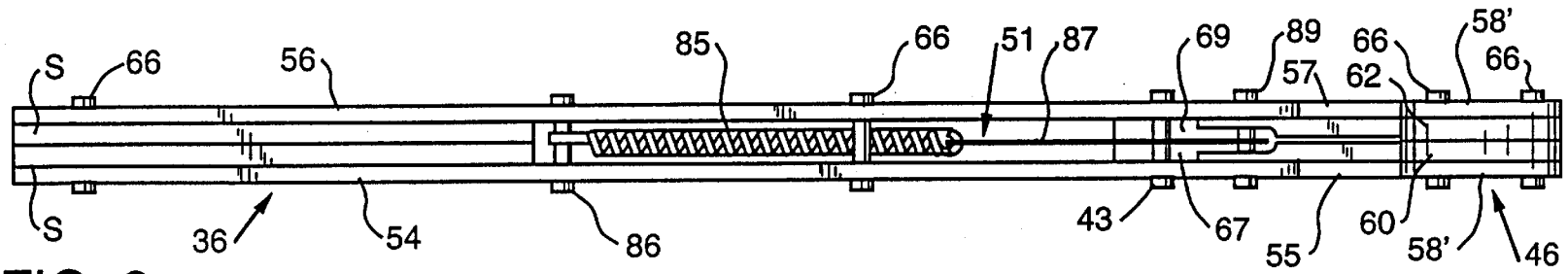
FIG. 2 is a top view of the pliers shown in FIG. 1.
Figure 3:
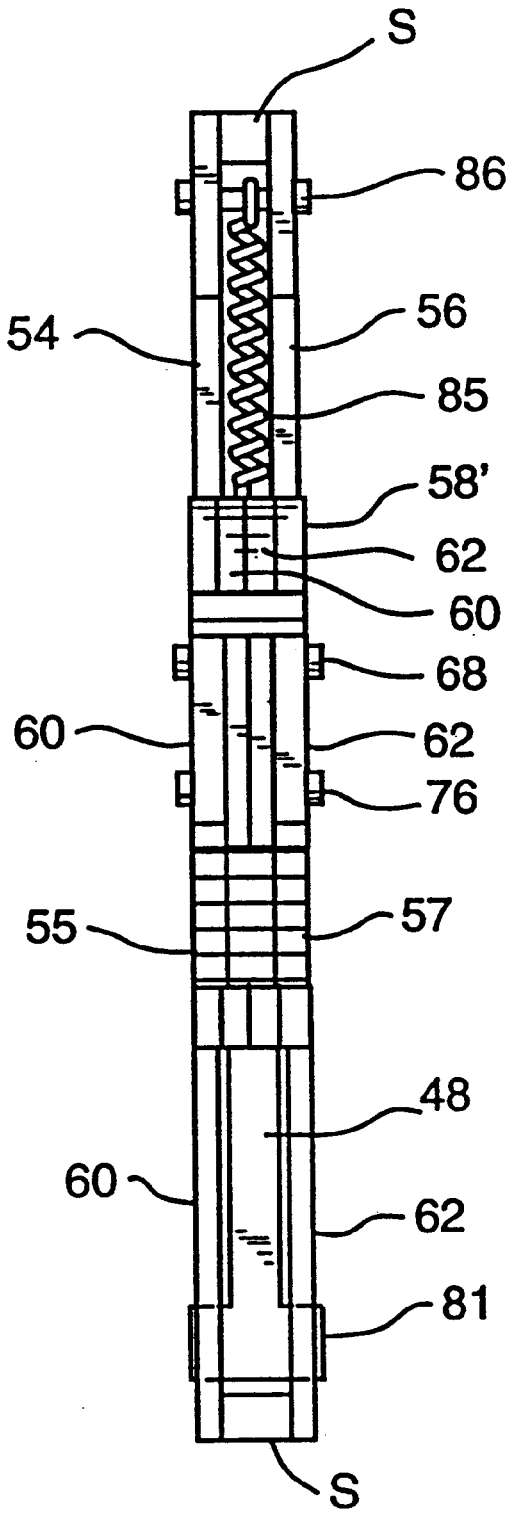
FIG. 3 is a front view of the pliers shown in FIG. 1.

Referring to FIGS. 1–6, there is shown a preferred embodiment of the pliers 30 of the present invention. The pliers 30 are capable of applying an initial grasping force to a workpiece W and of augmenting the initial grasping force applied to the workpiece W.

As used herein, the term "initial grasping force" means the force a user can initially apply to a workpiece by hand pressure on the handles of the pliers and is a function of the mechanical advantage that can be obtained when the pivot point is as close to the jaws as practical and the handles are as long as practical. Most conventional pliers and self-adjusting pliers offer about the same relationships between the jaw and handle portions to the pivot point and thus offer essentially no difference in the maximum initial grasping force a user can apply to a workpiece.

As used herein, the term "augmenting the initial grasping force" or "augmented grasping force" means actively multiplying or augmenting the initial grasping force a user can apply to a workpiece beyond what is possible with conventional pliers and self-adjusting pliers. It provides enhanced mechanical advantage and allows a user to grasp a workpiece with much greater force than possible with conventional pliers or self-adjusting pliers for a given amount of hand pressure against the handles.

As used herein, the term "angular displacement" means angle of rotation of the handles and the jaws of the pliers about their respective pivot points as the handles are moved toward each other and the jaws are moved toward each other.

In the present invention, force augmentation is accomplished by articulating at least one of the elements that comprise a handle and a jaw by interposing, for example, a linkage between handle and jaw so that the relative movement between them is either accelerated or decelerated. This linkage can be configured to multiply and augment the initial grasping force exerted on a workpiece by the jaws for a given hand force applied to the handles, as described in more detail below. Other arrangements, as disclosed herein, may also be provided for achieving force augmentation. It will be appreciated following a review of the description set forth herein and the drawings that the invention provides pliers that lessen the effort and strain on a worker's hand and thereby improve his or her safety and productivity.

The pliers 30 include a first plier member 32 and a second plier member 34 interconnected, as will be described in detail herein, in order to easily and efficiently adjust to the size of a given workpiece in order to initially grasp the workpiece and apply an initial grasping force thereto and to augment the initial grasping force applied to the workpiece. The first plier member 32 includes a handle portion 36, an intermediate portion 38, a jaw portion 40 and a link means, generally designated by reference numeral 41, for interconnecting the handle portion 36 and the intermediate portion 38. Preferably, the link means 41 is pivotally connected to the handle portion 36 and is pivotally connected to the intermediate portion 38. The second plier member 34 includes a handle portion 42, an intermediate portion 44 and a jaw portion 46.

The first plier member 32 and second plier member 34 are preferably formed of laminated construction. As shown best in FIGS. 1–3, the first plier member 32 includes relatively spaced apart first and second outer laminations 54 and 56 which form the handle portion 36. The intermediate portion 38 and the jaw portion 40 are also formed from first and second laminations 55 and 57. Inner lamination 58 may be provided on the jaw portion 40 between the laminations 55 and 57 to fill the gap between the laminations 55 and 57.

The second plier member 34 includes first and second laminations 60 and 62 that form the handle portion 42, the intermediate portion 44 and the jaw portion 46. As shown in the accompanying Figures, the assortment of laminations which make up the first plier member 32 and the second plier member 34 of the pliers 30 are constructed and arranged such that relative movement between the first plier member and the second plier member 34 enable an initial grasping force to be applied to the workpiece and for augmenting of the initial grasping force applied to the workpiece. It will be appreciated that the assortment of laminations described herein may be positioned or layered in various arrangements, other than as shown, to form the pliers 30. For example, the pliers 30 may be constructed with laminations 54, 56 and 55, 57 in the center and laminations 60, 62 positioned external thereto. Outer laminations 58' may be provided to extend the width of the jaw 46 to be equal to the width of the jaw 40.

The link means 41 includes link members 67, 69. The link members 67, 69 are preferably positioned between the laminations 55, 57 that form the intermediate portion 38 of the first plier member 32 and between the laminations 54, 56 which form the handle portion 36 of the first plier member 32. Specifically, the link members 67, 69, which are preferably identical, are pivotally connected at one end by a pin 43 to the handle portion 36 and are pivotally connected at another end to the intermediate portion 38 by a pin 45. The operation of the link members 67, 69 in relation to operation of the pliers 30 will be described in more detail herein.

The assortment of laminations described herein are preferably interconnected by a plurality of pins or rivets 66, in a manner as is generally known in order to retain the laminated construction of the pliers 30 together. The laminations are preferably blanked, stamped or laser-cut from heat-treatable sheet steel or high-grade or high-carbon steel. Handle grip covers (not shown) and internal spacers S to fill the gaps between laminations may be provided on the handle portions. The pliers 30 can also be manufactured using forged steel, structural plastics, fiber reinforced composite materials or combinations thereof.

The pliers 30 include first pivot means formed on the intermediate portions 38 and 44 to permit the jaw portions 40 and 46 to converge on a workpiece and apply an initial grasping force to the workpiece in response to an initial movement of the handle portions 36 and 42 toward each other. The pliers 30 also include second pivot means on the intermediate portions 38 and 44 to permit further convergence of the jaw portions 40 and 46 in response to continued movement of the handle portions 36 and 42 toward each other for augmenting the initial grasping force applied to the workpiece. Preferably, the second pivot means is positioned closer to the jaw portions 40 and 46 than the first pivot means so that a greater mechanical advantage may be obtained when using the pliers 30.

With particular reference to FIGS. 1 and 4–6, the first and second pivot means will be explained in more detail. The first pivot means includes a pivot member or pivot pin 68 on the intermediate portion 44 of the second plier member 34. The pivot pin 68 may be loosely trapped between the laminations 60, 62 or may be attached to the intermediate portion 44, for example, by mechanical interference fit, by providing a grooved center section of pivot pin 68 (not shown), by spring action if pivot pin 68 is a rolled spring pin (not shown), or by welding or other means which are generally known in the art. The first pivot means further includes a positioning slot 70 formed in the intermediate portion 38 of the first plier member 32. It will be appreciated that the positioning slot 70 is formed on both the first and second laminations 55 and 57. The positioning slot 70 includes a generally arcuate portion 72 and a shifting slot portion 74 in communication with the generally arcuate portion 72. The pivot pin 68 is movable and slidably received in the positioning slot 70.

The second pivot means includes a pawl 75 pivotally secured by a pivot pin 76 to the intermediate portion 38 of the first plier member 32. The pliers 30 also include a generally arcuate rack 78 formed on the intermediate portion 44 of the second plier member 34. The rack 78 includes a plurality of teeth 79 and the pawl 75 also includes one or more teeth 77 formed on a side thereof adjacent the plurality of teeth 79 formed on the rack 78. It will be appreciated that the teeth 79 define locking surfaces formed on the rack 78 and that the teeth 77 formed on the pawl 75 are positioned for cooperation with the teeth 79.

Figure 4:
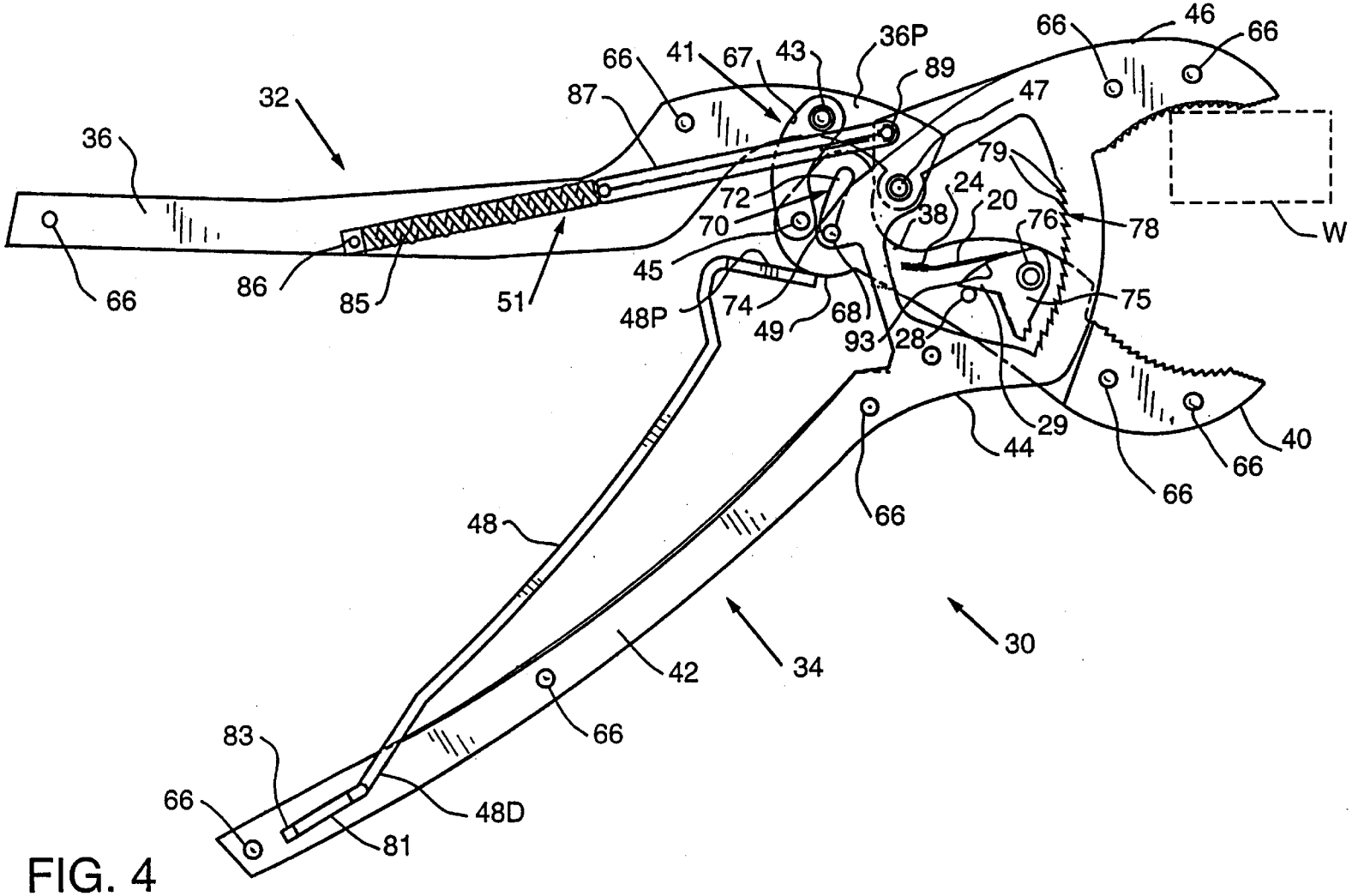
FIG. 4 is a simplified side elevational view of the pliers shown in FIG. 1 in a fully open position.
Figure 4A:
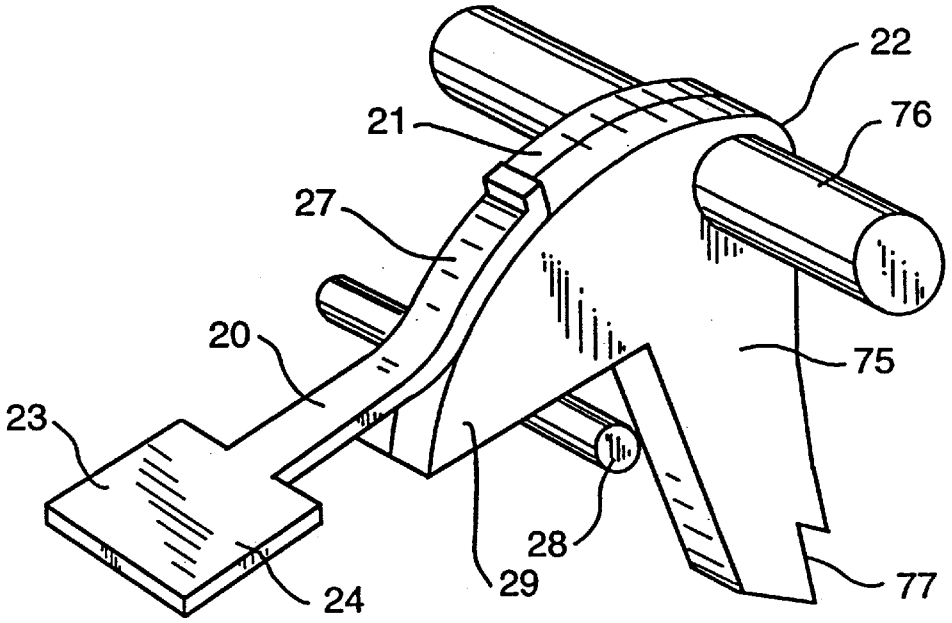
FIG. 4*a* is a perspective view of a preferred pawl arrangement utilized with the pliers shown in FIG. 1.

As best shown in FIG. 4*a,* also provided are spring means, such as leaf spring 20 secured to the intermediate portion 38 of the first plier member 32 for urging the pawl 75 into a generally concentric relationship with the rack 78 during the initial movement of the handle portions 36 and 42 toward each other to apply an initial grasping force to the workpiece and for urging the teeth 77 of the pawl 75 into engagement with the teeth 79 of the rack 78 during the continued movement of the handle portions 36 and 42 toward each other for augmenting the initial grasping force. The pawl 75 includes a top surface 21, a bearing surface 22 formed on the same side of the pawl 75 as the teeth 77 and a pawl extension 29 for cooperating with pawl stop pin 28. Preferably, the bearing surface 22 is formed adjacent the top surface 21 of the pawl 75. It will be appreciated that the pawl 75 may be a single member constructed and arranged to operate between the outer laminations 55 and 57 of the first plier member 32 or may be multiple members constructed and arranged to operate in conjunction between the laminations 55 and 57. It will be further appreciated that whether the pawl 75 is of single or multiple member construction, the pawl 75 must remain capable of movement with respect to the first plier member 32.

The leaf spring 20 includes a first end having laterally extending tabs 23 and 24 for receipt in notches 25 and 26, respectively, that are formed on the intermediate portion 38 of the first plier member 32. The leaf spring 20 also includes a second end 27 positioned for cooperating with the top surface 21 of the pawl 75 during the urging of the pawl 75 into a concentric relationship with the rack. The second end 27 of the leaf spring 20 is also positioned for cooperating with the pawl 75 during the urging of the teeth 77 into engagement with the teeth 79. The leaf spring 20 impinges on the top surface 22 of the pawl 75 to bias the lower side of the pawl extension 29 into contact with pin 28 such that the teeth 77 of pawl 75 are out of engagement with teeth 79 of rack 78 while the first pivot pin 68 is seated in the shifting slot portion 74 of positioning slot 70 when the handle portions 36 and 42 and jaw portions 40 and 46 converge on a workpiece in order to self-adjust and apply an initial grasping force on the workpiece.

During operation of the pliers 30, the leaf spring 20 keeps the pawl 75 in a fixed relationship to the rack 78 when the pliers 30 are not contacting a workpiece. When a workpiece is encountered and the pivot pin 68 is forced out of the shifting slot portion 74 of the positioning slot 70, the pawl 75 is forced toward the rack 78. When the bearing surface 22 of the pawl 75 contacts the rack 78, it forces the pawl 75 to pivot its teeth 77 toward engagement with the teeth 79. As the teeth 77 and 79 engage and the handle portions 36 and 42 are further squeezed together, the pawl 75 is fully engaged in the rack 78 while the handle portion 36 and the leaf spring 20 continue to rotate about the pivot pin 76. The leaf spring 20, and more particularly, the second end 27 thereof, cooperates with the top surface 21 of the pawl 75 to keep pressure on the pawl 75 biasing it toward engagement with the rack 78. Meshing of the teeth 77 and 79 causes the lower side of pawl extension 29 to be lifted away from contact with pin 28 against the bias of the leaf spring 20. Leaf spring 20 maintains teeth 77 and 79 in positive engagement while the further clamping force is applied to the workpiece to apply force augmentation to the workpiece and, after use, returns pawl 75 into a disengaged position where the lower side of pawl extension 29 is again in contact with pin 28 to cause pawl teeth 77 to be disengaged from rack teeth 79 and allow pliers 30 to return to the original, fully open position.

It will be appreciated that the pawl arrangement described herein, and specifically the leaf spring 20 for cooperating with the pawl 75, provides a simple and efficient mechanical means for maintaining the pawl 75 in a concentric relationship with the rack 78. It will also be appreciated that leaf spring 20, as shown, is for illustrative purposes only and that other configurations and arrangements for such a spring means may be provided in accordance with the present invention.

The generally arcuate portion 72 of the positioning slot 70 has a curvature generally centered about the pivot pin 76 which mounts the pawl 75. In addition, the generally arcuate rack 78 has a curvature generally centered about the pivot pin 68. The relative movement of the first plier member 32 and the second plier member 34 against each other are therefore controlled by the precise geometry of defined pivot points and corresponding arcs. This approach allows tight tolerances and precise, predictable and repeatable adjustment in grasping action with minimal looseness in the pliers 30.

The pliers 30 also include a biasing spring, such as leaf spring 48 structured to bias the pivot pin 68 toward the shifting slot portion 74 of the positioning slot 70 as the pivot pin 68 is movable from the shifting slot portion 74 toward the generally arcuate portion 72 of the positioning slot 70 against the bias of the leaf spring 48 during the continued movement of the handle portions 36 and 42 toward each other. Specifically, the intermediate portion 38 of the first plier member 36 includes a bearing surface 49 where a proximal end 48P of the leaf spring 48 acts against the bearing surface 49 to bias the pivot pin 68 toward the shifting slot portion 74 of the positioning slot 70. A distal end 48D of the leaf spring 48 is attached to a distal end of the handle portion 42 of the second plier member 34 by, for example, tabs 81 formed on the distal end of the leaf spring 48 extending through slots 83 formed in the laminations 60 and 62 which form the handle portion 42 of the second plier member 34. Alternatively, the leaf spring 48 may be attached to the distal end of the handle portion 42 by, for example, pins or rivets (not shown) extending through the handle and the distal end of the leaf spring 48 or other suitable means.

The bearing surface 49 is generally arcuate and has a curvature generally centered about a center point of the pivot pin 68 when the pivot pin 68 is positioned in the shifting slot portion 74 of the positioning slot 70.

A further biasing means, such as generally designated by reference numeral 51, may be provided for biasing the handle portions 36 and 42 away from each other and the jaw portions 40 and 46 away from each other to maintain the pliers 30 in a fully open position (as shown in FIG. 4) or to return the pliers 30 to a fully open position following operation of the pliers 30. The biasing means may include, for example, an extension spring 85 attached at one end by a pin 86, or other suitable means, to the handle portion 36 of the first plier member 32. The other end of the spring 85 may be hooked to a spring link 87 or other suitable means. The opposing end of the spring link 87 is in turn attached by a pin 89 to the intermediate portion 44 of the second plier member 34. Preferably, the spring link 87 is a rigid member that is constructed and arranged for cooperation with the spring 85 for biasing the handle portions 36 and 42 away from each other and the jaw portions 40 and 46 away from each other. The spring means 51 is preferably positioned between the link members 67, 69 and the laminations 54 and 56 which form the handle portion 36 of the first plier member 32. This arrangement allows for operation of the pliers 30 without the biasing means 51 interfering with the operation of the various elements of the pliers 30. In addition, other types of springs located at various locations on the pliers 30 may be provided for performing essentially the same function, as will be recognized by one of ordinary skill in the art.

Figure 5:
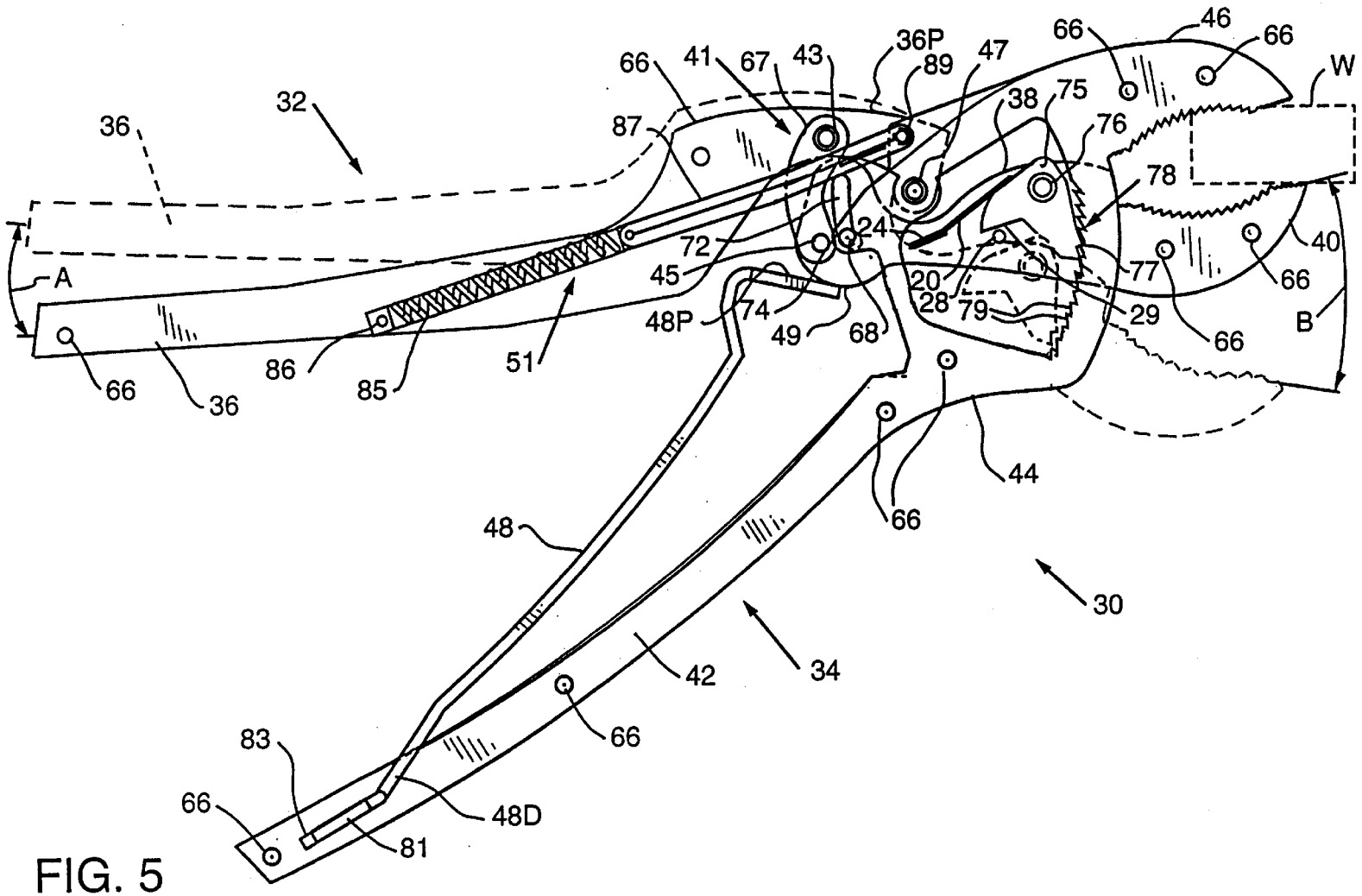
FIG. 5 is a further side elevational view of the pliers shown in FIG. 4 with the pliers being operated to initially grasp a workpiece.
Figure 6:
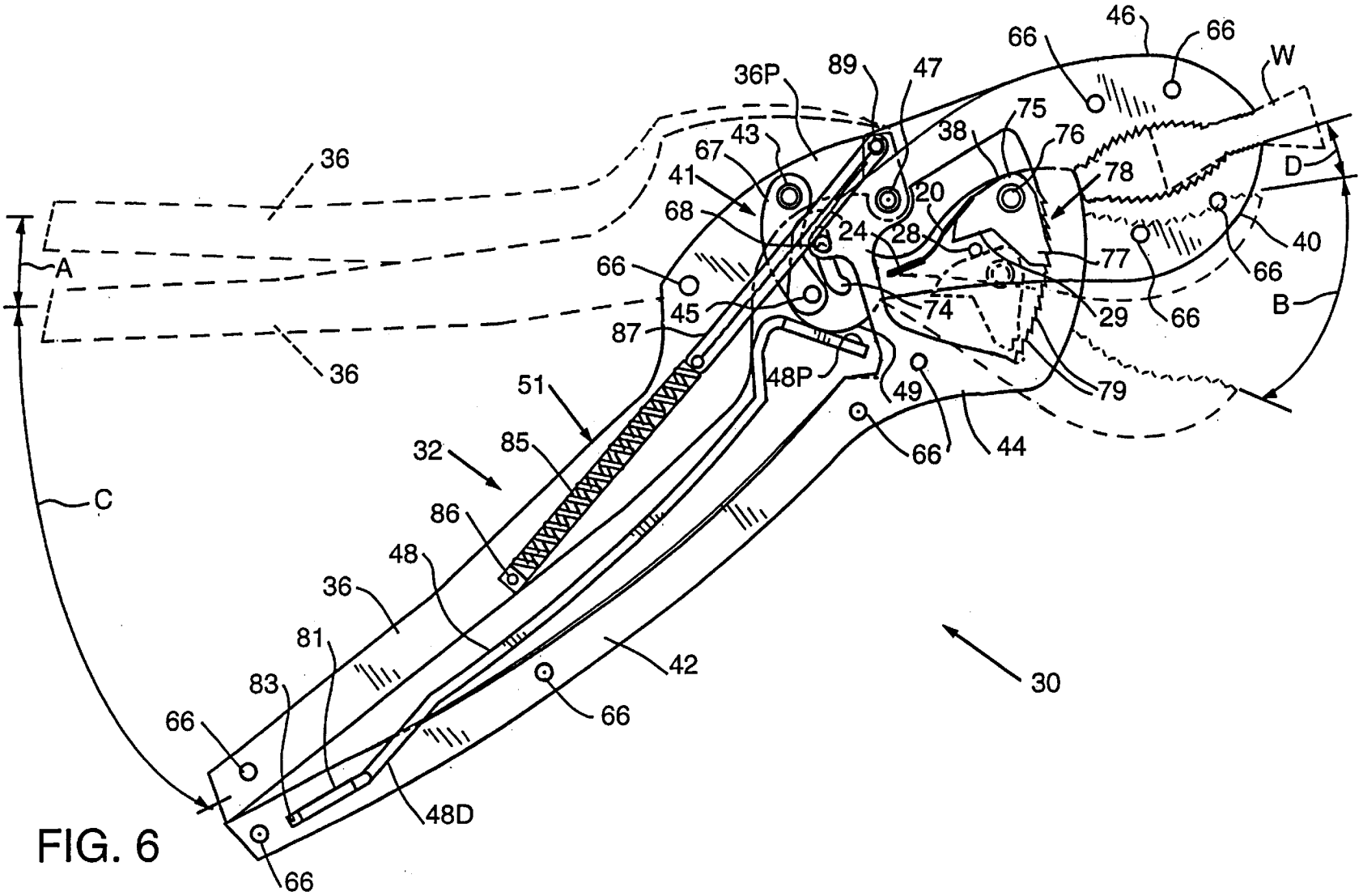
FIG. 6 is a further side elevational view of the pliers shown in FIGS. 4 and 5 with the pliers being operated to augment the initial grasping force applied to the workpiece.

Referring specifically to FIGS. 4–6, the operation of the pliers 30 will be described in detail. Specifically, FIG. 4 shows the pliers 30 in a fully opened position with the handle portions 36 and 42 being at the farthermost point away from each other and the jaw portions 40 and 46 being at the farthermost point away from each other. As described, the spring means 51 serves to maintain the pliers 30 in the fully open position. The pivot pin 68 is positioned in the shifting slot portion 74 of the positioning slot 70 while the pliers 30 are in the fully opened position. The pivot pin 68 is also positioned in the shifting slot portion 74 of the positioning slot 70 when the handle portions 36 and 42 are initially moved toward each other in response to the user squeezing the handle portions 36 and 42 to initially grasp the workpiece W. The leaf spring 48 acts against the bearing surface 49 to bias the pivot pin 68 to remain in the shifting slot portion 74 of the positioning slot 70. During this movement of the handle portions 36 and 42 toward each other and the jaw portions 40 and 46 toward each other, the pivot pin 68 acts as the active pivot point of the pliers 30.

While the pliers 30 are in the fully opened position (see FIG. 4), the bias of the leaf spring 48 against the bearing surface 49 on the intermediate portion 38 of the first plier member 36 in cooperation with the pawl stop pin 28 and spring 20 serves to maintain the pawl 75 in concentric alignment with and out of engagement with the rack 78. As long as the pivot pin 68 remains positioned in the shifting slot portion 74 of the positioning slot 70, the pawl 75 remains spaced apart from and disengaged from the rack 78. As the handle portions 36 and 42 are moved toward each other, the jaw portions 40 and 46 also move toward each other resulting in the pawl 75 moving upward at a relatively spaced distance from the rack 78. During this initial movement, the pivot pin 68 remains positioned in the shifting slot portion 74 of the positioning slot 70 and the pivot pin 68 continues to act as the active pivot point of the pliers 30.

Referring to FIG. 5, initial movement of the handle portions 36 and 42, and more specifically movement of the handle portion 36 toward the handle portion 42, is illustrated. Due to the structure of the link means 41 and its being pivotally interconnected to the handle portion 36 by pin 43 and also being pivotally interconnected to the intermediate portion 38 by pin 45, movement or angular displacement, as indicated by arrow A, of handle portion 36 results in the movement or angular displacement of the jaw portion 40, as indicated by arrow B. This movement is also accomplished by a proximal end 36P of the handle portion 36 being pivotally interconnected by pin 47 to the intermediate portion 44 of the second plier member 34. It will be appreciated that the angular displacement A during this initial adjustment is less than the angular displacement B. During this initial adjustment the pivot pin 68 acts as the active pivot of the pliers 30, as described.

Referring to FIG. 6, continued movement of the handle portion 36 toward the handle portion 42 results in the augmenting the initial grasping force being applied to the workpiece W. Specifically, once the jaw portions 40 and 46 grasp the workpiece W and apply the initial grasping force thereto (see FIG. 5), continued convergence of the handle portions 36 and 42 results in the link means 41 rotating the intermediate portion 38 and the jaw portion 40 of the first plier member 32. In addition, engagement of the jaw portions 40 and 46 with the workpiece W and the continued movement of the handle portion 36 toward the handle portion 42 results in the active pivot of the pliers shifting from the pivot pin 68 to the pivot pin 76 which mounts the pawl 75, which at this stage of the operation is seated into full engagement with the rack 78. Continued movement of the handle portion 36 toward the handle portion 42 results in the pivot pin 68 moving into the generally arcuate portion 72 of the positioning slot 70 against the bias of the leaf spring 48. The pivot pin 68 will continue to move upward within the generally arcuate portion 72 of the positioning slot 70 as the handle portion 36 is moved closer to the handle portion 42 during compression of the workpiece W.

FIG. 6 shows the handle portion 36 at the end of the stroke for augmenting the initial grasping force applied to the workpiece W. In addition, jaw portions 40 and 46 are shown as applying the maximum compression to the workpiece W. Following the initial movement of the handle portion 36 toward the handle portion 42 to apply the initial grasping force to the workpiece W (see FIG. 5), the movement or angular displacement, as indicated by arrow C, of the handle portion 36 results in the movement or angular displacement, as indicated by arrow D, of jaw portion 40. It will be appreciated that during this stage of operation to augment the initial grasping force applied to the workpiece W the angular displacement C is greater than the angular displacement D.

In operation of the pliers 30 of the invention, it will be appreciated that the first plier member 32 and the second plier member 34 are coupled such that the handle portions 36 and 42 and the jaw portions 40 and 46 converge on a workpiece at different angular rates in order to self-adjust and apply an initial grasping force to a workpiece and at different angular rates to provide for augmenting of the initial grasping force applied to the workpiece. Initially, the handle portions 36 and 42 need to converge toward each other only slightly in order to cause the jaw portions 40 and 46 to travel very rapidly from the fully open to the position where the jaw portions 40 and 46 are in engagement with the workpiece and applying a grasping force thereto. Next, the structure of the pliers 30 allows for the rate of convergence of the jaw portions 40 and 46 to be much less than the rate at which the handle portions 36 and 42 converge, therefore providing for the augmenting of the initial grasping force applied to the workpiece and magnifying the gripping force of the pliers 30.

As described, one of the essential features of the invention that allows for the various angular rates of convergence between the handle portions 36 and 42 and the jaw portions 40 and 44 is the indirect connection between the handle portion 36 and the intermediate portion 38 provided by the link means 41. Once the jaw portions 40 and 46 contact the workpiece W and apply the initial grasping force thereto, continued movement of the handle portion 36 toward the handle portion 42 causes the link members 67 and 69 to rotate the intermediate portion 38 and the jaw portion 40 of the first plier member 32 and augment the initial grasping force applied to the workpiece W. The amount of force augmentation is dictated by the geometry of pivot points in relation to jaws 40, 46 and positioning slot 70. For example, the angular movement of jaw 40 when initially grasping a workpiece W can be accelerated in relation to the angular movement of the handle 36 by moving the pin 45 which mounts the link members 67 and 69 to the intermediate portion 38 closer to the shifting slot portion 74 of the positioning slot 70. However, this will also increase the effort required to move the handle 36. Similarly, moving pin 43 which mounts link members 67, 69 to handle 36 closer to pin 47 which mounts handle 36 to intermediate member 44 tends to decrease movement of the jaw 40 in relation to movement of the handle 36 when applying additional grasping force to the workpiece W to increase force augmentation. In addition, the length of the link members 67, 69 and the distance from pivot point 76 at which the handle 36 is attached to intermediate member 44, helps to further determine the degree of force augmentation. Generally, there is a trade off situation where achieving more rapid initial closure of the jaw 40 when adjusting the jaw 40 to initially grasp a workpiece also requires greater initial hand force but also permits a greater amount of force augmentation to be achieved with the remaining range of handle movement. Specific applications will benefit from different geometric relationships among the above-mentioned elements.

As described, the leaf spring 48 engages the bearing surface 49 formed on the intermediate portion 38 of the first plier member and biases the pivot pin 68 toward the shifting slot portion 74 of the positioning slot 70. The leaf spring 48 is structured to exert constant upward pressure against the bearing surface 49 at the point of contact therewith. During the continued movement of the handle portion 36 toward the handle portion 42 to apply the force augmentation, the leaf spring 48 is deflected downward as the pivot pin 68 moves upward from the shifting slot portion 74 into the generally arcuate portion 72 of the positioning slot 70. The leaf spring 48 adds a minimal amount of backpressure against the handle portions 36 and 42. The leaf spring 48 assists to move the handle portions 36 and 42 and the jaw portions 40 and 46 to the fully open position once hand pressure is removed from the pliers 30. The leaf spring 48 also ensures that the pivot pin 68 returns to the shifting slot portion 74 of the positioning slot 70 following operation of the pliers 30.

Figure 7:
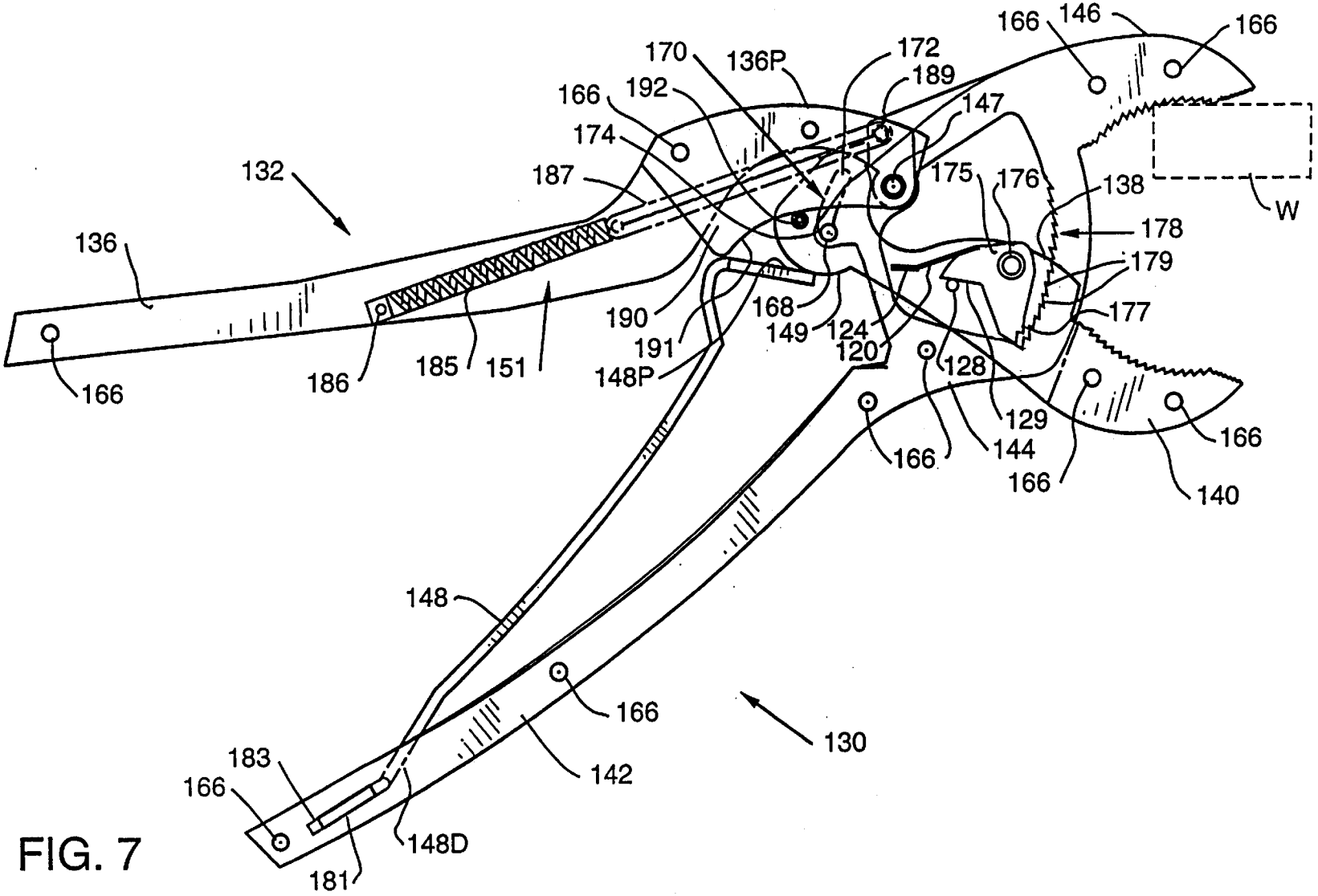
FIG. 7 is a simplified side elevational view of a further embodiment of the invention, showing the pliers in a fully open position.
Figure 8:
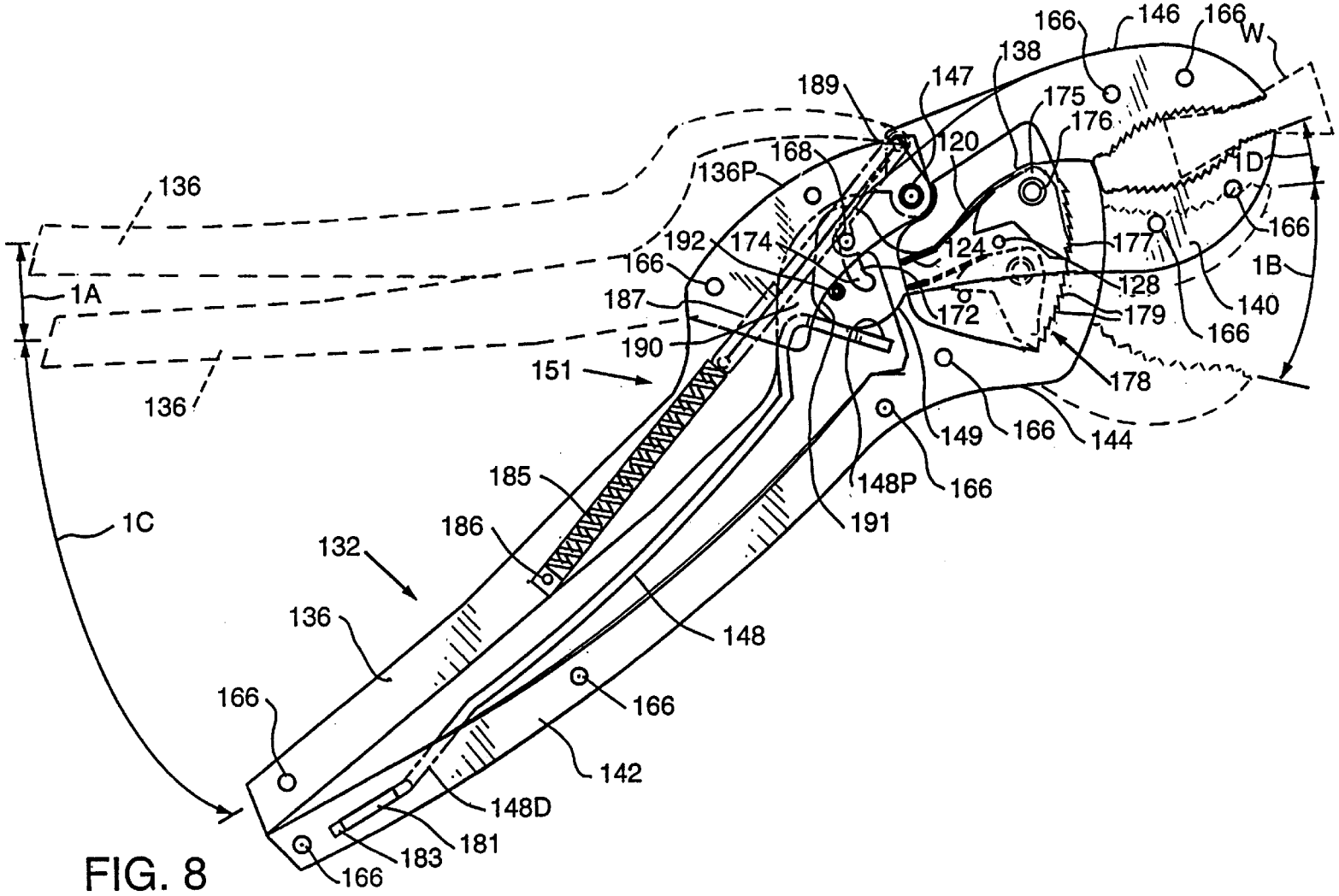
FIG. 8 is a further side elevational view of the pliers shown in FIG. 7 with the pliers being operated to augment the initial grasping force applied to the workpiece.

Referring to FIGS. 7 and 8 there are shown simplified side elevational views of a further embodiment of the invention. FIG. 7 illustrates pliers 130 in a fully open position while FIG. 8 illustrates the pliers 130 with the pliers 130 being operated to augment the initial grasping force applied to the workpiece W. As described herein for pliers 30, the pliers 130 are capable of applying an initial grasping force to the workpiece W and augmenting the initial grasping force applied to the workpiece W. It will be understood that the pliers 130 are similar in structure to the pliers 30, as described in detail herein, and that similar components have like reference numbers preceded by a "1". The similarities will be apparent to one of ordinary skill in the art following a review of FIGS. 7 and 8.

The essential difference between the pliers 130 and the pliers 30 is that the link means 41 of the pliers 30 has been eliminated. For pliers 130, the handle portion 136 of the first plier member 132 is formed separately from the intermediate portion 138 of the first plier member 132. More specifically, the handle portion 136 of the first plier member 132 includes an integrally formed extension 190 which includes cam means, as will be described in more detail herein, for cooperating with cam follower means, which will also be described in more detail herein, formed on the intermediate portion 138 of the first plier member 132. The cam means and the cam follower means cooperate with the first pivot, namely the pivot pin 168 which is received in the positioning slot 170 (as described in detail herein for the previous embodiment), for applying a grasping force to the workpiece W. The cam means and cam follower means also cooperate with the second pivot means, namely the pawl 175 and the rack 178 (as described herein for the previous embodiment), for augmenting the grasping force applied to the workpiece W.

The cam means includes a cam surface 191 formed on the extension 190 adjacent the intermediate portion 138 of the first plier member 132. The cam follower means includes a cam follower 192 on the intermediate portion 138 positioned generally adjacent the shifting slot portion 174 of the positioning slot 170. The cam surface 191 is positioned for cooperation with the cam follower 192.

Still referring to FIGS. 7 and 8, the operation of the pliers 130 will be described in detail. As stated, FIG. 7 shows the pliers 130 in a fully opened position with the handle portions 136 and 142 being at the farthermost point away from each other and the jaw portions 140 and 146 also being at the farthermost point away from each other. As in the previously described embodiment, the spring means, generally designated by reference numeral 151, serves to maintain the pliers 130 in the fully open position. The pivot pin 168 is positioned in the shifting slot portion 174 of the positioning slot 170 while the pliers 130 are in the fully opened position. The pivot 168 is also positioned in the shifting slot portion 174 when the handle portions 136 and 142 are initially moved toward each other in response to the user squeezing the handle portions 136 and 142 to grasp the workpiece W. The leaf spring 148 acts against the bearing surface 149 to bias the pivot pin 168 to remain in the shifting slot portion 174. During this initial movement of the handle portions 136 and 142 toward each other and the jaw portions 140 and 146 toward each other, the pivot pin 168 acts as an active pivot of the pliers 130.

Movement of the handle portions 136 and 142, and more specifically movement of the handle portion 136 toward the handle portion 142, results in the movement or angular displacement, as indicated by arrow 1A, of handle portion 136 and also results in the movement or angular displacement of the jaw portion 140, as indicated by arrow 1B. It will be appreciated, as described in detail for the previous embodiment, that the angular displacement 1A during this initial adjustment is less than the angular displacement 1B.

Referring more specifically to FIG. 8, continued movement of the handle portion 136 toward the handle portion 142 results in the augmentation of the initial grasping force being applied to the workpiece W. Specifically, once the jaw portions 140 and 146 initially grasp the workpiece W and apply the initial grasping force thereto, continued convergence of the handle portions 136 and 142 results in the cam surface 191 cooperating with the cam follower 192 to rotate the intermediate portion 138 and the jaw portion 140 of the first plier member 132. In addition, engagement of the jaw portions 140 and 146 with the workpiece W and the continued movement of the handle portion 136 toward the handle portion 142 results in the active pivot of the pliers shifting from the pivot pin 168 to the pivot pin 176 which mounts the pawl 175. Continued movement of the handle portion 136 toward the handle portion 142 results in the pivot pin 168 moving into the generally arcuate portion 172 of the positioning slot 170.

Shown in solid line in FIG. 8 is the position of the pliers 130 at the end of the stroke for augmenting the initial grasping force applied to the workpiece W. Jaw portions 140 and 146 are shown as applying the maximum compression to the workpiece W. Following the initial movement of the handle portion 136 toward the handle portion 142 to apply the initial grasping force to the workpiece W, the continued movement or angular displacement, as indicated by arrow 1C, of the handle portion 136 results in the movement or angular displacement, as indicated by arrow 1D, of jaw portion 140. It will be appreciated that during this stage of operation to augment the initial grasping force applied to the workpiece W, the angular displacement 1C is greater than the angular displacement 1D.

In operation of the pliers 130, it will be appreciated that the first plier member 132 and the second plier member 134 are coupled such that the handle portions 136 and 142 and the jaw portions 140 and 146 converge on a workpiece at different angular rates in order to self-adjust and apply the initial grasping force to a workpiece and at different angular rates to provide for augmenting of the initial grasping force applied to the workpiece. Initially, the handle portions 136 and 142 converge toward each other only slightly in order to cause the jaw portions 140 and 146 to travel the full distance from fully open to the position where the jaw portions 140 and 146 are in engagement with the workpiece W and applying the initial grasping force thereto. Next, during continued convergence of the handle portions 136, 142, the structure of the pliers 130 allows for the rate of convergence of the jaw portions 140 and 146 to be much smaller than the rate at which the handle portions 136 and 142 converge, therefore providing for the augmenting of the initial grasping force applied to the workpiece and magnifying the gripping force of the pliers 130.

Figure 9:
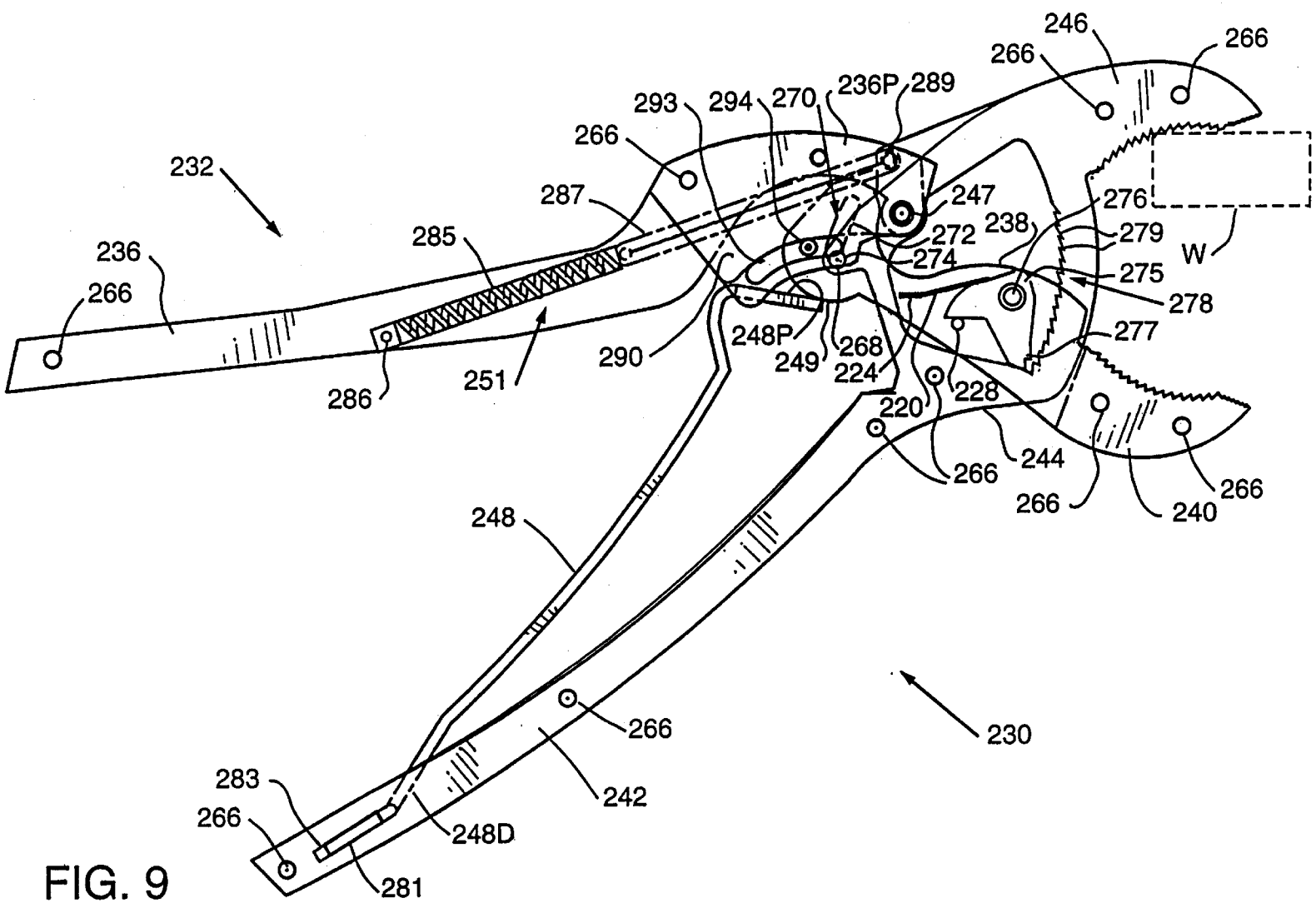
FIG. 9 is a simplified side elevational view of a further embodiment of the invention, showing the pliers in a fully open position.
Figure 10:
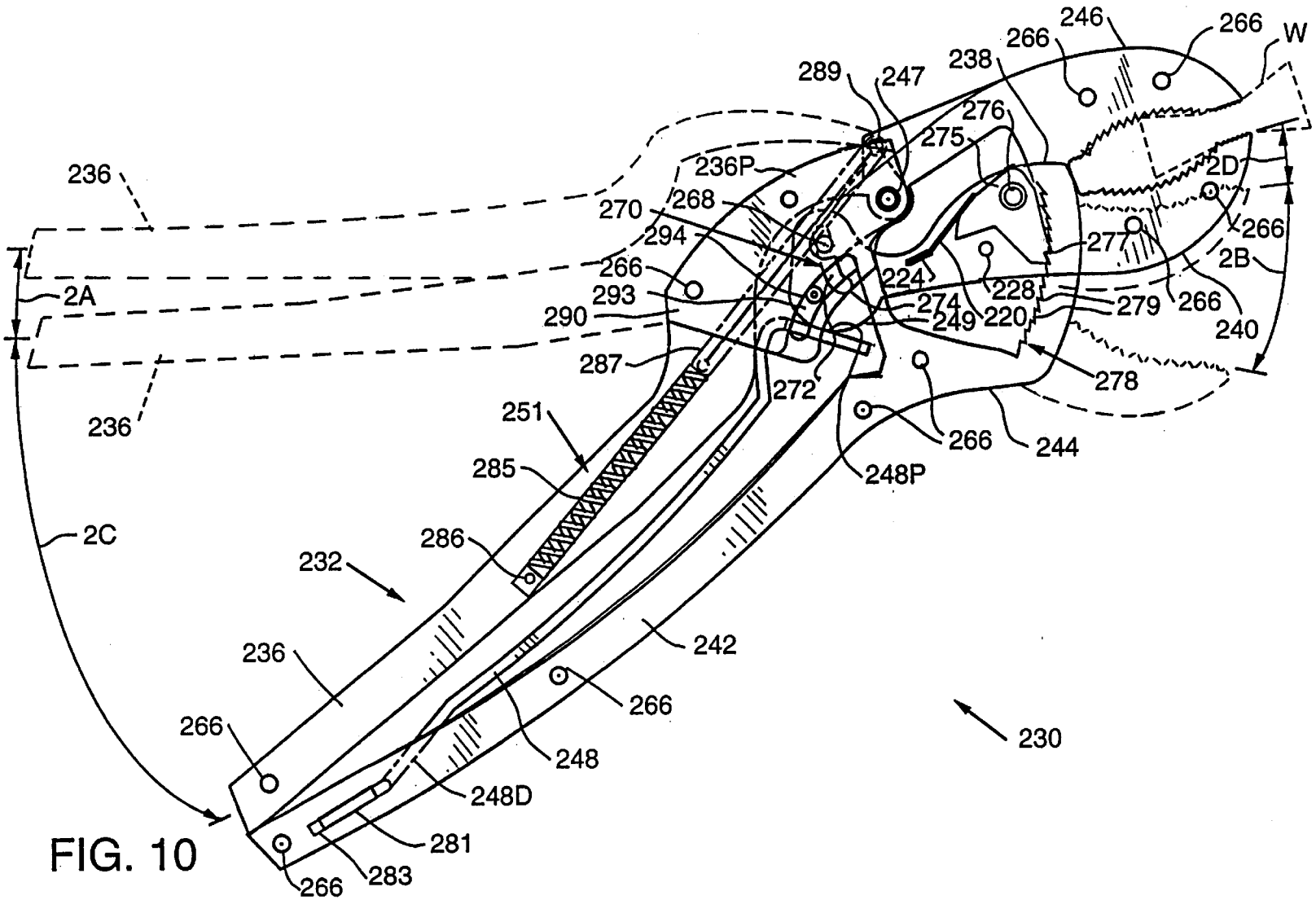
FIG. 10 is a further side elevational view of the pliers shown in FIG. 10, with the pliers being operated to augment the initial grasping force being applied to the workpiece.

Referring to FIGS. 9 and 10, there are shown simplified side elevational views of yet a further embodiment of the invention. FIG. 9 illustrates pliers 230 in a fully open position while FIG. 10 illustrates the pliers 230 with the pliers 230 being operated to augment the initial grasping force applied to the workpiece W. It will be understood that the pliers 230 are similar in structure to the pliers 30 and 130, as described in detail herein and that similar components include like reference numbers preceded by a "2". The similarities will be apparent to one of ordinary skill in the art following a review of the Figures appended hereto.

Specifically, pliers 230 operate in essentially the same manner as pliers 130. However, rather than employing the cam surface 191 and the cam follower 192, pliers 230 include a cam slot 293 formed in the extension 290 that is integrally formed with the handle portion 236 of the first plier member 232. A cam follower or cam pin 294 is formed on the intermediate portion 238 of the first plier member 232 adjacent the positioning slot 270. As shown, the cam follower or cam pin 294 is received in and moveable within the cam slot 293. Similar to the embodiment shown in FIGS. 7 and 8 and described herein, convergence of the handle portions 236 and 242 results in the cam pin 294 cooperating with the cam slot 293 to rotate the intermediate portion 238 and the jaw portion 240 of the first plier member 232.

FIG. 10 shows the position of the pliers 230 at the end of the stroke for augmenting the initial grasping force applied to the workpiece W. Shown in dotted line is the movement of the handle portions 236 and 242, and more specifically movement of the handle portion 236 toward the handle portion 242, which results in the movement or angular displacement, as indicated by arrow 2A of handle portion 236 and also results in the movement or angular displacement of the jaw portion 240, as indicated by arrow 2B. It will be appreciated, as described in more detail for the previous embodiments, that the angular displacement 2A during this initial adjustment is less than the angular displacement 2B. Following the initial movement of the handle portion 236 toward the handle portion 242 to apply the initial grasping force to the workpiece W, the movement or angular displacement, as indicated by arrow 2C, of the handle portion 236 results in the movement or angular displacement, as indicated by arrow 2D, of jaw portion 240. It will be appreciated that during this stage of operation to augment the initial grasping force applied to the workpiece W, the angular displacement 2C is greater than the angular displacement 2D.

Referring to FIGS. 11–14, there is shown another preferred embodiment of the pliers 30 of the present invention. It will be understood that the pliers 330 are similar in structure to the pliers 30, 130 and 230, as described in detail herein and that similar components include like reference numbers preceded by a "3". The similarities will be apparent to one of ordinary skill in the art following a review of the Figures appended hereto. The pliers 330 are capable of applying an augmented grasping force to a workpiece W without having the jaws shift against each other and which also provide an auditory indication that the rack engaging member is operating. The augmented grasping force is achieved by a multi-stage process. The described structure of the pliers of the invention allows the movement of the handle portions of the two plier members to be segmented into the following four distinct stages: Stage 1, at rest and fully open, Stage 2, the jaws are fully open, but the rack engaging structure is in soft engagement with the rack; Stage 3, the jaws are closing and self-adjusting to the size of the workpiece until they initially contact the workpiece while the rack engaging structure remains in soft engagement with the rack; and Stage 4, the jaws are compressing the workpiece and the rack engaging structure is in hard engagement with the rack, while continued handle movement provides an augmented grasping force.

Figure 12:
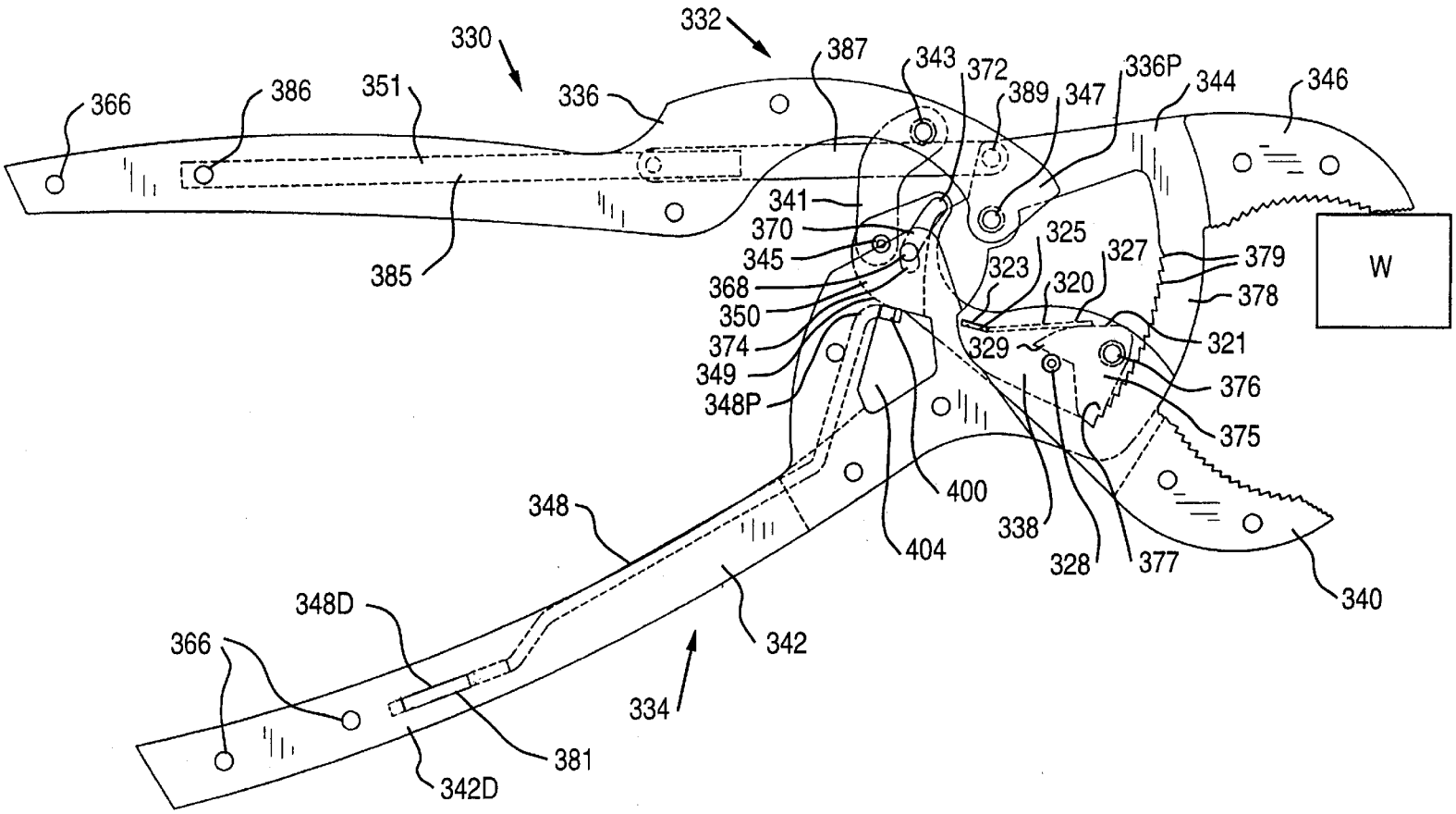
FIG. 12 is a side elevational view of a four stage device, showing interaction of the dog-leg slot, first pivot pin, link means and pawl following the prepatory handle movement resulting in the pliers being in Stage 2.

As used herein, "preparatory handle movement" is the motion that occurs between Stage 1 and Stage 2 and means the movement of the handle portions of the plier members toward each other in response to a user holding the pliers with only light pressure on the handles against the bias of the second biasing means to cause the first pivot member to shift from its position in the shifting slot to the transitional portion of the dog-leg slot and the rack engaging structure of the second pivot to move into soft engagement without effecting convergence of the jaws. (FIG. 12).

Figure 13:
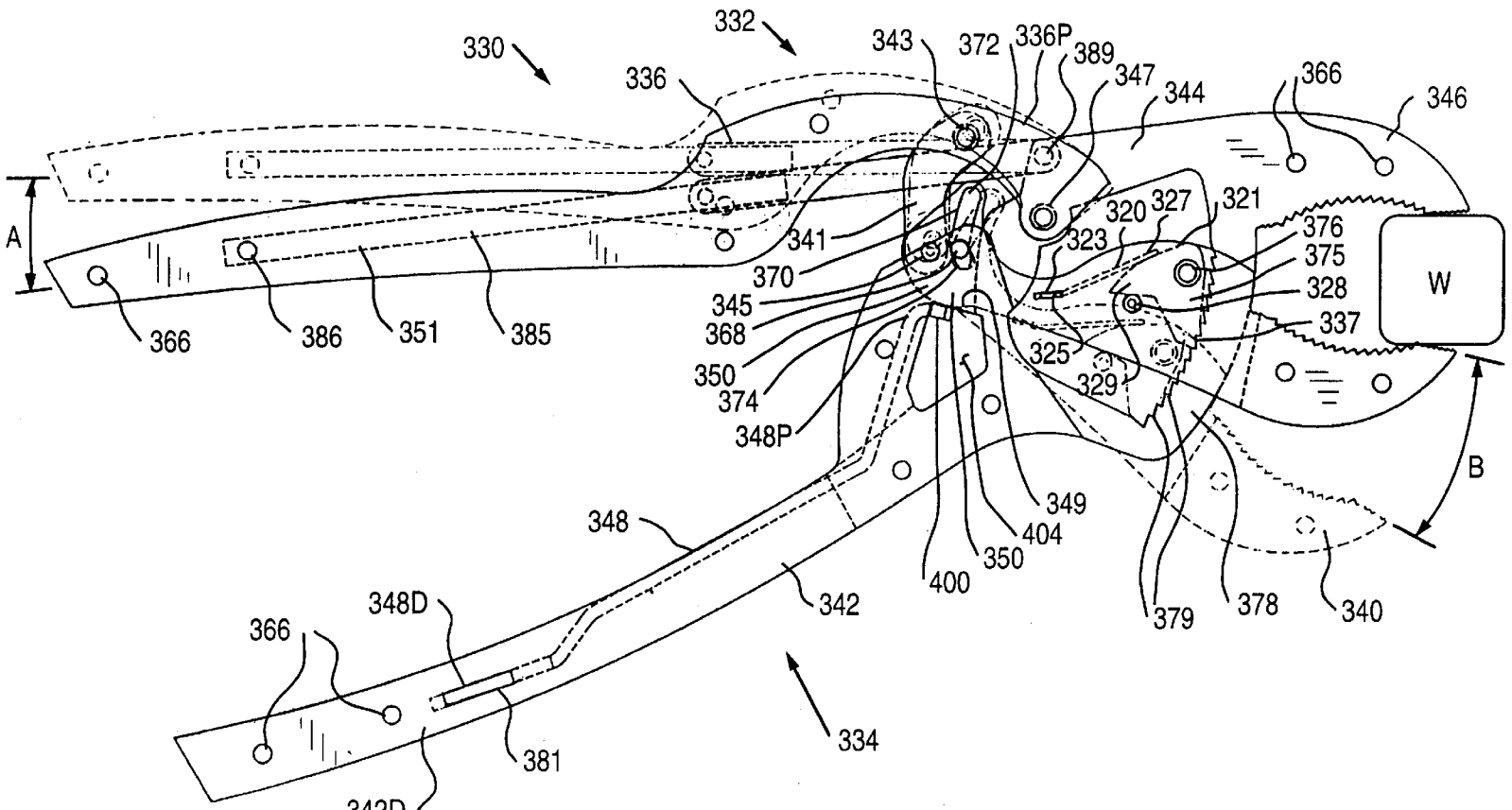
FIG. 13 is a side elevational view of a four stage device, showing interaction of the dog-leg slot, first pivot pin, link means and pawl during the self-adjustment of Stage 3.

As used herein, "self-adjusting handle movement" is the motion which occurs after Stage 2 in association with Stage 3 and means the movement of the handle portions of the plier members toward each other under continued hand pressure on the handles causing the jaw portion of the first plier member to converge on the workpiece until the jaws make contact with the workpiece while the first pivot remains in the transitional portion of the dog-leg slot. (FIG. 13).

Figure 14:
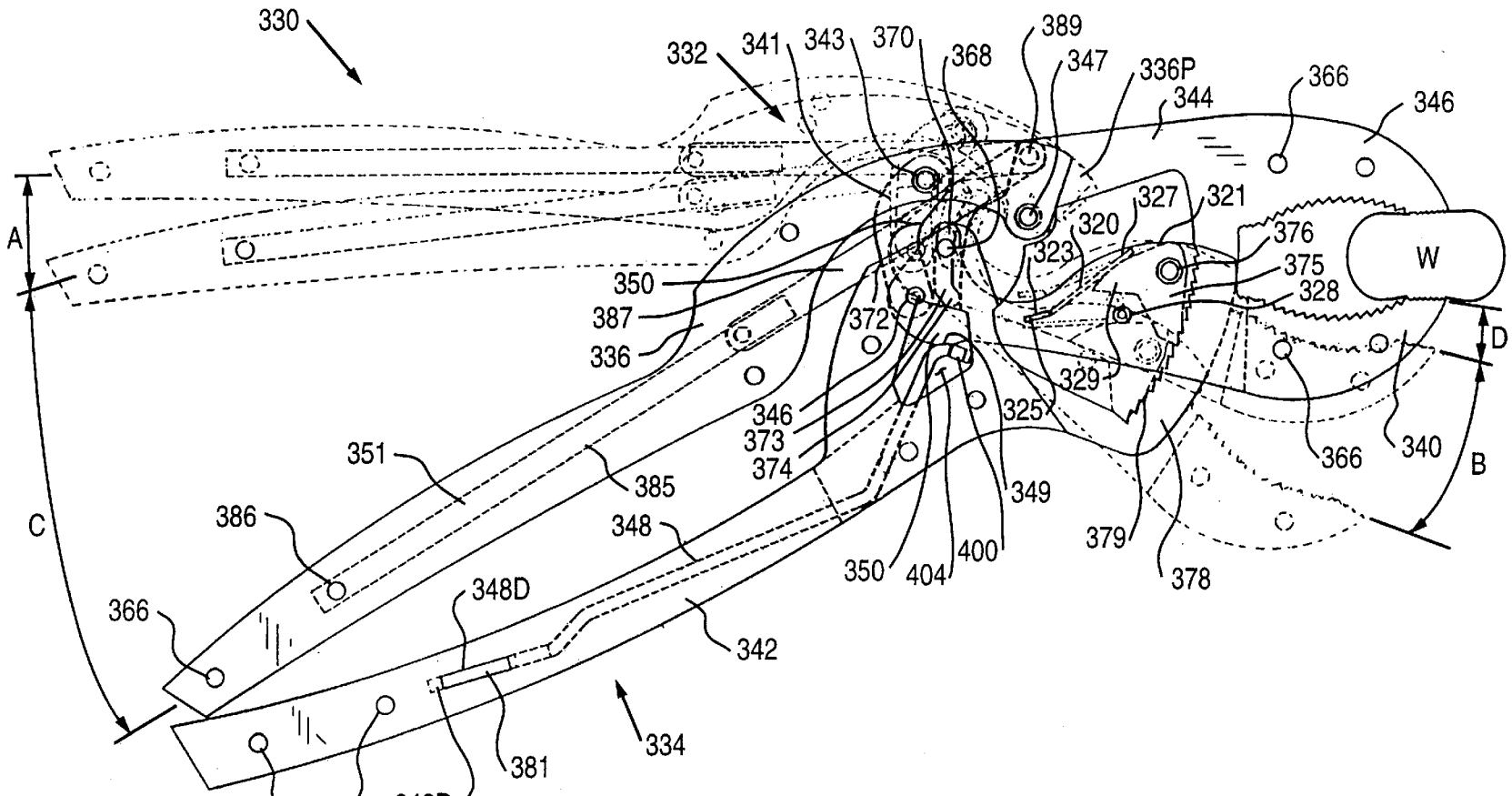
FIG. 14 is a side elevational view of a four stage device, showing interaction of the dog-leg slot, first pivot pin, link means and pawl during the continued handle movement with augmented grasping force of stage 4.

As used herein, "continued handle movement with augmented grasping force" is the motion associated with Stage 4 and means the continued movement of the handle portions of the plier members toward each other as the jaw portion of the first plier member compresses the workpiece to apply the augmented grasping force against the workpiece causing the first pivot to leave the transitional portion of the dog-leg slot and move into the positioning slot. (FIG. 14).

As used herein, "soft engagement" of the rack engaging structure means that the teeth of the rack engaging structure and the teeth of the rack are contacting each other, but are not carrying any load. Thus, the teeth of the rack engaging structure can move over the teeth of the rack, but only in the direction of jaw closure.

As used herein, "hard engagement" of the rack engaging structure means that the teeth of the rack engaging structure and the teeth of the rack are locked together under clamping load. Thus, the teeth of the rack engaging structure cannot move over the teeth of the rack against the direction of jaw closure and can resist the augmented clamping force.

In this embodiment of the present invention, the shifting motion between the jaws is isolated so that it occurs only during the transition between the first and second stages. The linkage of the present embodiment causes the first pivot member to travel out of the shifting slot and into the transitional portion prior to the initial convergence of the jaws. Thus, the shifting motion occurs only during Stage 1 when the first pivot member travels from the shifting slot into the transitional portion before the jaws close in on a workpiece and therefore doesn't interfere with grasping a workpiece. This shifting motion also causes the rack engaging structure to enter into soft engagement with the rack. Thus, during the self-adjusting handle movement associated with Stage 3, the rack engaging structure travels over the arcuate rack while in soft engagement and thereby creates an auditory indication, i.e. a ratcheting sound, that informs the user that the rack engaging structure is operating.

As shown in FIGS. 11–14, pliers of this embodiment 330 include a first plier member 332 and a second plier member 334 interconnected, as will be described in detail herein, in order to easily and efficiently self-adjust to the size of a given workpiece, apply a grasping force thereto, and augment the grasping force applied to the workpiece. The first plier member 332 includes a handle portion 336, an intermediate portion 338, a jaw portion 340 and a coupling, generally designated by reference numeral 341, for interconnecting the handle portion 336 and the intermediate portion 338. Preferably,the coupling 341 is pivotally connected to the handle portion 336 and is pivotally connected to the intermediate portion 338. The second plier member 334 includes a handle portion 342, an intermediate portion 344 and a jaw portion 346.

The first plier member 332 and second plier member 334 are preferably formed of laminated construction. As shown best in FIG. 15, the first plier member 332 includes relatively spaced apart first and second outer laminations 354 and 356 which form the handle portion 336. The intermediate portion 338 and the jaw portion 340 are also formed from first and second laminations 355 and 357. Inner lamination 358 may be provided on the jaw portion 340 between the laminations 355 and 357 to fill the gap between the laminations 355 and 357. Alternatively, cast or molded jaw inserts can be provided.

The second plier member 334 includes first and second laminations 360 and 362 that form the handle portion 342. Laminations 363, 364 form the intermediate portion 344 and the jaw portion 346. As shown in FIG. 12, the assortment of laminations which make up the first plier member 332 and the second plier member 334 of the pliers 330 are constructed and arranged such that preparatory handle movement, i.e. movement between the handle member of the first plier member 332 and the handle member of the second plier member 334 causes the second pivot to shift into engagement with the rack 378 (described below) without requiring the jaws to converge on the workpiece, for enabling self-adjustment of the first jaw portion 340 to move it into soft contact with the workpiece, and finally for enabling continued handle movement to augment the grasping force applied to the workpiece.

Figure 15:
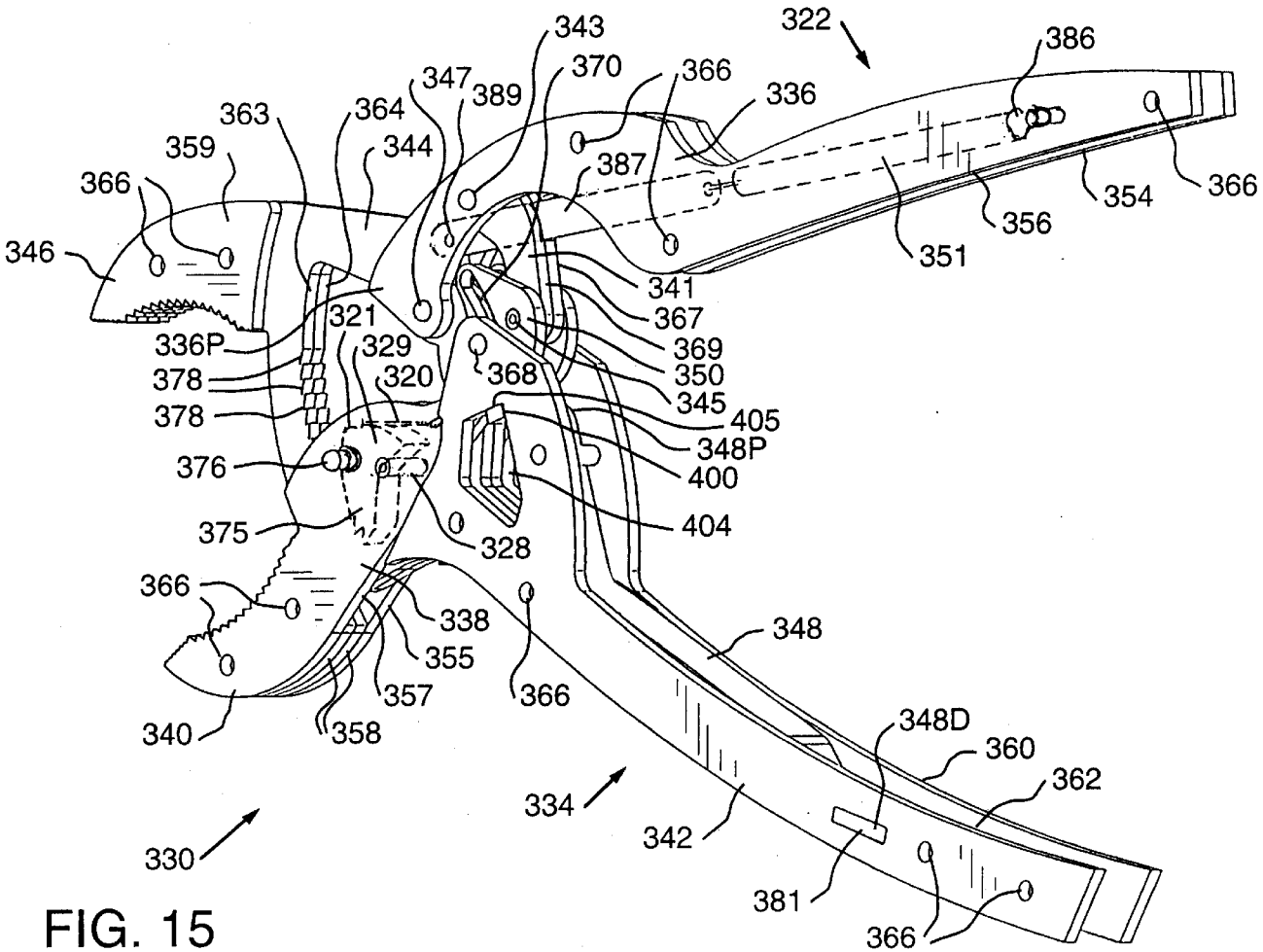
FIG. 15 is a perspective view of an alternate, four stage device, showing a leaf spring with side tabs cooperating with the spring control openings.

It will be appreciated that the assortment of laminations described herein and shown in FIG. 15 may be positioned or layered in various arrangements, other than as shown, to form the pliers 330. For example, the pliers 330 may be constructed with laminations 354, 356 and 355, 357 in the center and laminations 360, 362 positioned external thereto. Outer laminations 359 may be provided to extend the width of the jaw 346 to be equal to the width of the jaw 340. Alternatively, cast or molded jaw elements can be provided for the same purpose.

The coupling 341 in a preferred embodiment includes link members 367, 369. The link members 367, 369 are preferably positioned between the laminations 355, 357 that form the intermediate portion 338 of the first plier member 332 and between the laminations 354, 356 which form the handle portion 336 of the first plier member 332. Specifically, the link members 367, 369, which are preferably identical, are pivotally connected at one end by a pin 343 to the handle portion 336 and are pivotally connected at another end to the intermediate portion 338 by a pin 345. The operation of the link members 367, 369 in relation to operation of the pliers 330 will be described in more detail herein. As may be appreciated by anyone knowledgeable in the art, the coupling 341 may also consist of a single link member that may be cast or manufactured by other means generally known in the art.

The assortment of laminations described herein are preferably interconnected by a plurality of pins or rivets 366, or other means which are generally known in the art, in order to retain the laminated construction of the pliers 330 together. The laminations are preferably blanked, stamped or cut from heat-treatable sheet steel or high-grade or high-carbon steel. Handle grip covers (not shown) and internal spacers (not shown) to fill the gaps between laminations may be provided on the handle portions. The pliers 330 or parts thereof can also be manufactured using forged steel, cast alloys, sintered metals, structural plastics, fiber reinforced composite materials or combinations thereof.

As shown in FIGS. 11–14, the pliers 330 include first pivot means formed on the intermediate portions 338 and 344 to permit the jaw portions 340 and 346 to converge in response to movement of the handle portions 336 and 342 toward each other. The pliers 330 also include second pivot means on the intermediate portions 338 and 344 to permit further convergence of the jaw portions 340 and 346 in response to continued movement of the handle portions 336 and 342 toward each other for augmenting the grasping force applied to the workpiece. Preferably, the second pivot means is positioned closer to the jaw portions 340 and 346 than the first pivot means so that a greater mechanical advantage may be obtained when using the pliers 330.

The first pivot means includes a pivot member or pivot pin 368 on the intermediate portion 344 of the second plier member 334. The pivot pin 368 may be attached to the intermediate portion 344, for example, by mechanical interference fit, by providing a grooved center section of pivot pin 368 (not shown), by spring action if pivot pin 368 is a rolled spring pin (not shown), or by welding or other means which are generally known in the art. The first pivot means further includes a two-part slot 370 formed in the intermediate portion 338 of the first plier member 332. The two-part slot is preferably shaped as a dog-leg slot 370. It will be appreciated that the dog-leg slot 370 is formed on both the first and second laminations 355 and 357 (FIG. 15). The dog-leg slot 370 includes a generally arcuate positioning slot portion 372, a shifting slot portion 374 in communication with the generally arcuate portion 372, and a transitional portion 373 where the shifting slot portion 374 of the dog-leg slot 370 transitions into the generally arcuate positioning slot portion 372. The pivot pin 368 is movable and slidably received in the dog-leg slot 370. The pivot pin 368 is urged toward the shifting slot portion 374 of the dog-leg slot 370 by a second biasing means, preferably a handle spring 351 (described below) which also serves to urge the handle portions 336 and 342 away from each other and the jaw portions 340 and 346 away from each other to keep the pliers 330 in their fully open position and to return the pliers 330 to their fully open position after use. In an asymmetrical construction of the pliers that is similar to the construction of conventional scissors, only one dog-leg slot and only one corresponding pivot pin may be required, as can be appreciated by one familiar with the art.

The second pivot means includes a locking means on the first plier member 332 which interacts with the second plier member 334. In a preferred embodiment, the locking means is a pawl 375 pivotally secured by a pivot pin 376 to the intermediate portion 338 of the first plier member 332. If the locking means includes a pawl 375, the pliers 330 may also include a generally arcuate rack 378 formed on the intermediate portion 344 of the second plier member 334. The rack 378 includes a plurality of teeth 379 and the pawl 375 also includes one or more teeth 377 formed on a side thereof adjacent the plurality of teeth 379 formed on the rack 378. The pawl teeth 377 have a locking surface 398 which, during stages 2–4 is in contact with a locking surface 399 on the rack teeth 379 (FIGS. 12–14). The pawl teeth 377 may be in either soft engagement or hard engagement, as defined above, with the rack teeth 379. It will be appreciated that, when the teeth 377, 379 are in hard engagement, the teeth locking surfaces 398, 399 are in contact and are capable of carrying a load in the direction opposite the direction of closure of the first jaw portion 340. It will further be appreciated that, when the teeth 377, 379 are in soft engagement, as defined above, the pawl teeth 377 may move across the rack teeth 379 in the direction of closure of the first jaw portion 340. It will further be appreciated that other locking means, for example, a lock bar and lock plates, such as those used in caulking guns can be substituted for the rack and pawl.

Figure 11:
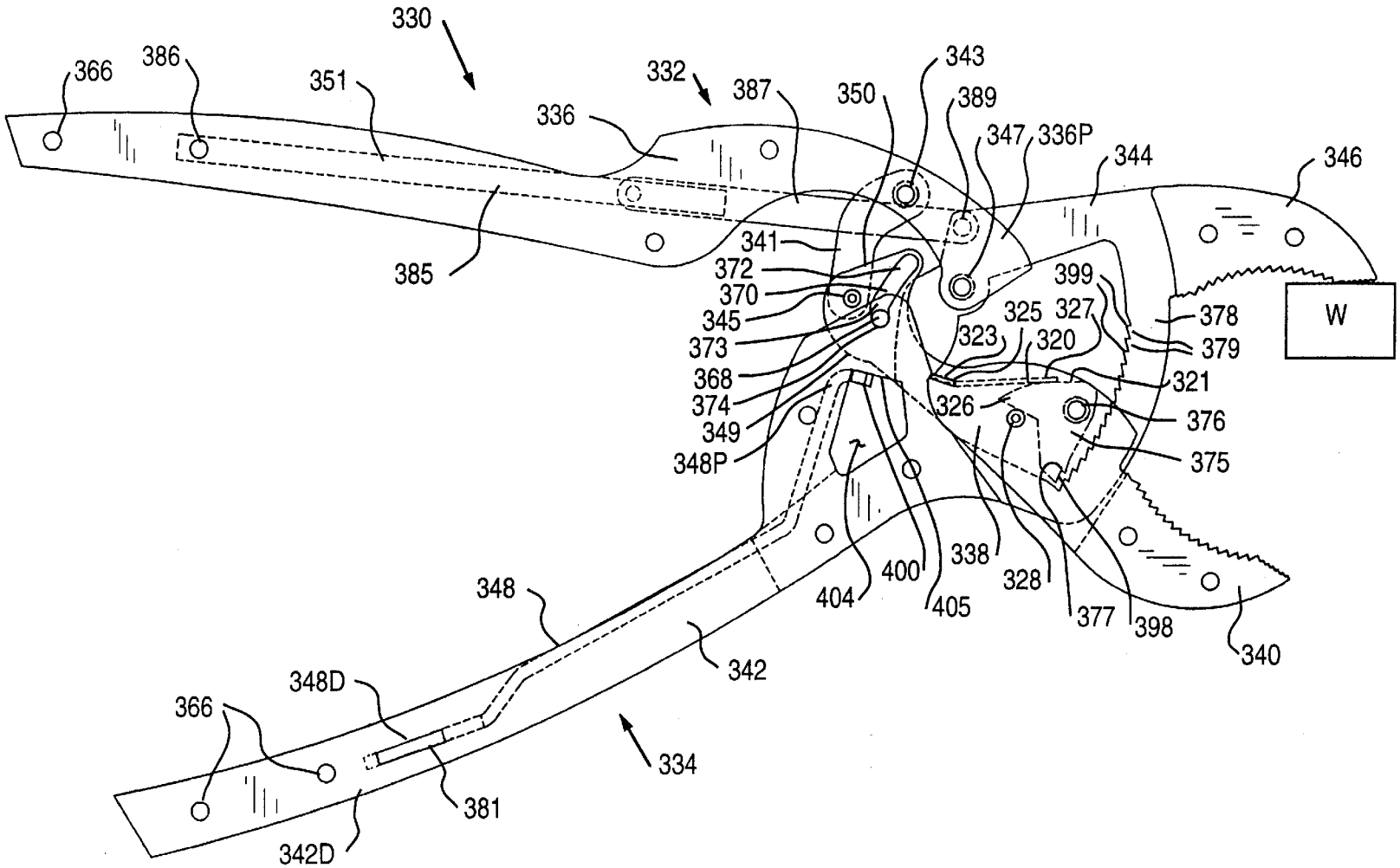
FIG. 11 is a side elevational view of a four stage device, showing interaction of the dog-leg slot, first pivot pin, link means and pawl in the fully open position of Stage 1.

As best shown in FIG. 11, also provided are spring means, such as pawl leaf spring 320 secured to the intermediate portion 338 of the first plier member 332 for urging the pawl 375 into a generally concentric relationship with the rack 378 while the pliers 330 are in the fully open position of Stage 1 with the handle portions 336 and 342 at their maximum distance from one another and jaws 340 and 346 at their maximum distance from one another.

Furthermore, pawl leaf spring 320 also urges teeth 377 of pawl 375 into soft engagement with teeth 379 of rack 378 during the continued convergence of the handle portions 336 and 342 as the pliers move from Stage 2 to Stage 3 for self-adjusting pliers 330 to the size of the workpiece and for augmenting the grasping force in Stage 4. The pawl 375 includes a top surface 321 which cooperates with pawl leaf spring 320, and a pawl extension 329 for cooperating with pawl stop pin 328. It will be appreciated that the pawl 375 may be a single member constructed and arranged to operate between the outer laminations 355 and 357 of the first plier member 332 or may be multiple members constructed and arranged to operate in conjunction between the laminations 355 and 357. It will be further appreciated that whether the pawl 375 is of single or multiple member construction, the pawl 375 must remain capable of movement with respect to both the first plier member 332 and the second plier member 334.

The pawl leaf spring 320 includes a first end having laterally extending tabs 323 and 324 for receipt in notches 325 and 326, respectively, that are formed on the intermediate portion 338 of the first plier member 332. The pawl leaf spring 320 also includes a second end 327 positioned for cooperating with the top surface 321 of the pawl 375 during the urging of the pawl 375 into a concentric relationship with the rack 378. The second end 327 of the pawl leaf spring 320 is also positioned for cooperating with the pawl 375 during the urging of the teeth 377 into engagement with the teeth 379. The pawl leaf spring 320 impinges on the top surface 322 of the pawl 375 to bias the lower side of the pawl extension 329 into contact with pawl stop pin 328 such that the teeth 377 of pawl 375 are out of engagement with, and concentrically aligned with, teeth 379 of rack 378, while the first pivot pin 368 is seated in the shifting slot portion 374 of dog-leg slot 370 when the pliers 330 are in Stage 1 the fully open position.

When the pliers are first prepared for use, slight hand pressure against the handle portions 336 and 342, such as is required to hold the tool lightly in one's hand in preparation of grasping a workpiece, causes the handle portions 336 and 342 to converge against the urging of the second biasing means 351. This convergence of the handles 336, 342 brings the pliers 330 from Stage 1 into Stage 2 by causing the first pivot pin 368 to be shifted out of its position in the positioning slot portion 374 of dog-leg slot 370 until pivot pin 368 has shifted to the transitional portion 373. Coincidentally, with the pivot pin 368 entering transitional portion 373, the teeth 377 of pawl 375 shift into soft engagement with teeth 379 of rack 378.

It should be appreciated that the preparatory handle movement that causes the pivot pin 368 to shift to the transitional portion 373 will also shift teeth 377 and 379 into soft engagement. As a result, engagement of the pawl 375 with the rack 378 will generally only occur when the jaws 340 and 346 are at their maximum distance from one another, that is, prior to the jaws 340 and 346 converging.

Also, when the pawl 375 is in engagement with the rack 378, the pawl leaf spring 320, and more particularly, the second end 327 thereof, cooperates with the top surface 321 of the pawl 375 to keep pressure on the pawl 375 biasing it toward engagement with the rack 378. Rotation of the first plier member 332 around pawl pivot pin 376 causes the pawl stop pin 328 to rotate away from contact with pawl extension 329 against the bias of the pawl leaf spring 320. Pawl leaf spring 320 maintains teeth 377 and 379 in soft engagement while the handle portions 336 and 342 further converge to self-adjust jaws 340 and 346 to the size of the workpiece and in hard engagement while augmented clamping force is applied to the workpiece. After use, when the handles 336 and 342 are released, pawl leaf spring 320 returns pawl 375 into a disengaged position where the lower side of pawl extension 329 is again in contact with pawl stop pin 328 to cause pawl teeth 377 to be disengaged from rack teeth 379 and allow pliers 330 to return to the Stage 1, fully open position.

Figure 16:
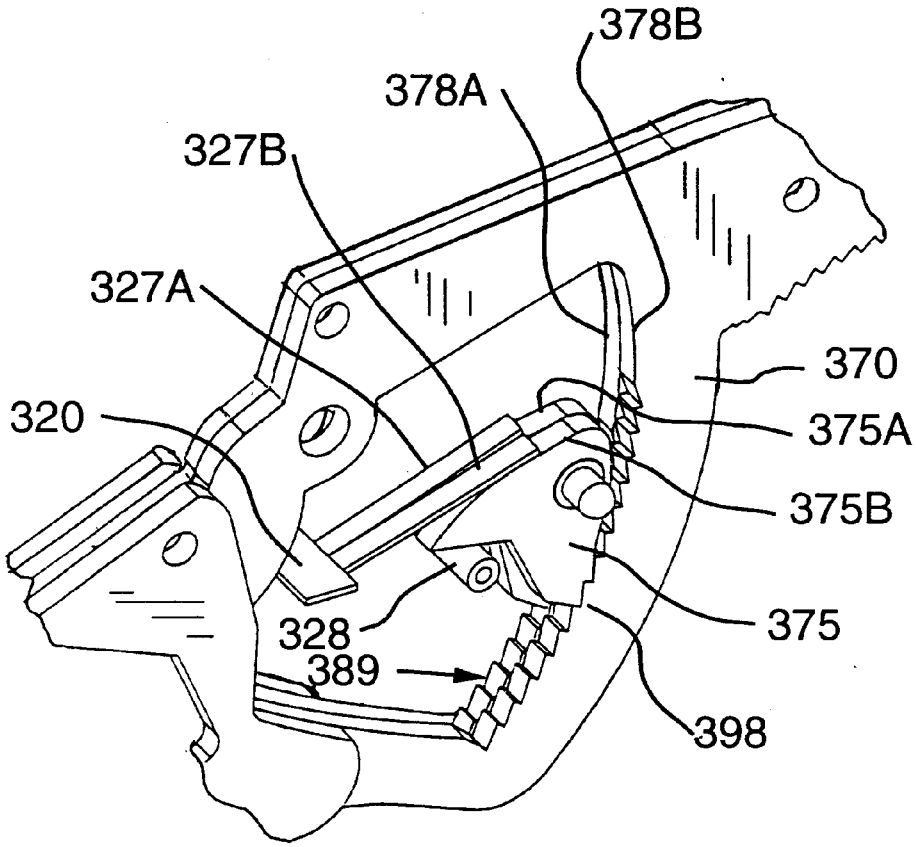
FIG. 16 is a partial view, with the top lamination removed, of a rack and rack engaging structure, formed of multiple laminations with off-set teeth.

Both rack 378 and pawl 375 may be formed of a single lamination or, as shown in FIG. 16, of a plurality of laminations, 378A, 378B and 375A, 375B respectively. If rack 378 is formed of multiple laminations, the teeth 379 of each lamination 378A, 378B may be offset. While fine teeth on both the rack 378 and pawl 375 render the pliers more responsive, there are practical limits to the tooth size that can be formed inexpensively using conventional manufacturing techniques. By slightly offsetting the teeth on rack laminations 378A, 378B, the relative spacing of teeth 379 may create the effect of finer teeth by causing corresponding pawl laminations 375A, 375B to alternatingly engage the teeth 379 on rack laminations 378A, 378B. This allows finer over-all pitch in order to minimize the handle movement required to move pawl 375 from soft engagement and seat it into hard engagement during the transition from Stage 3 to Stage 4. If pawl 375 is composed of individual laminations 375A, 375B which are sized to correspond with the laminations 378A, 378B, the pawl leaf spring 320, or other means for biasing the pawl 375 against a positive stop such as pin 328, may consist of independent spring elements or fingers 327A, 327B, whereby each element or finger 327A, 327B, individually biases each independent pawl lamination 375A, 375B toward pin 328 or into engagement with the rack 378. Such independent fingers 327A, 327B, are required in embodiments where the rack laminations 378A, 378B are offset against each other. Such fingers 327A, 327B, are also required when multiple pawl laminations 375A, 375B with offset tooth pitch, in combination with rack laminations with fully aligned teeth, are utilized to minimize this handle movement during the transition from Stage 3 to Stage 4. In these embodiments, the individual fingers of pawl spring 320 selectively and individually bias each pawl element 375A, 375B into respective engagement with the corresponding rack teeth 399.

Referring to FIGS. 11–14, it will be appreciated that the pawl arrangement described herein, and specifically the pawl leaf spring 320 for cooperating with the pawl 375, provides a simple and efficient mechanical means for maintaining the pawl 375 in a concentric relationship with the rack 378. It will also be appreciated that pawl leaf spring 320, as shown, is for illustrative purposes only and that other configurations and arrangements for such a spring means may be provided in accordance with the present invention.

Figure 17:
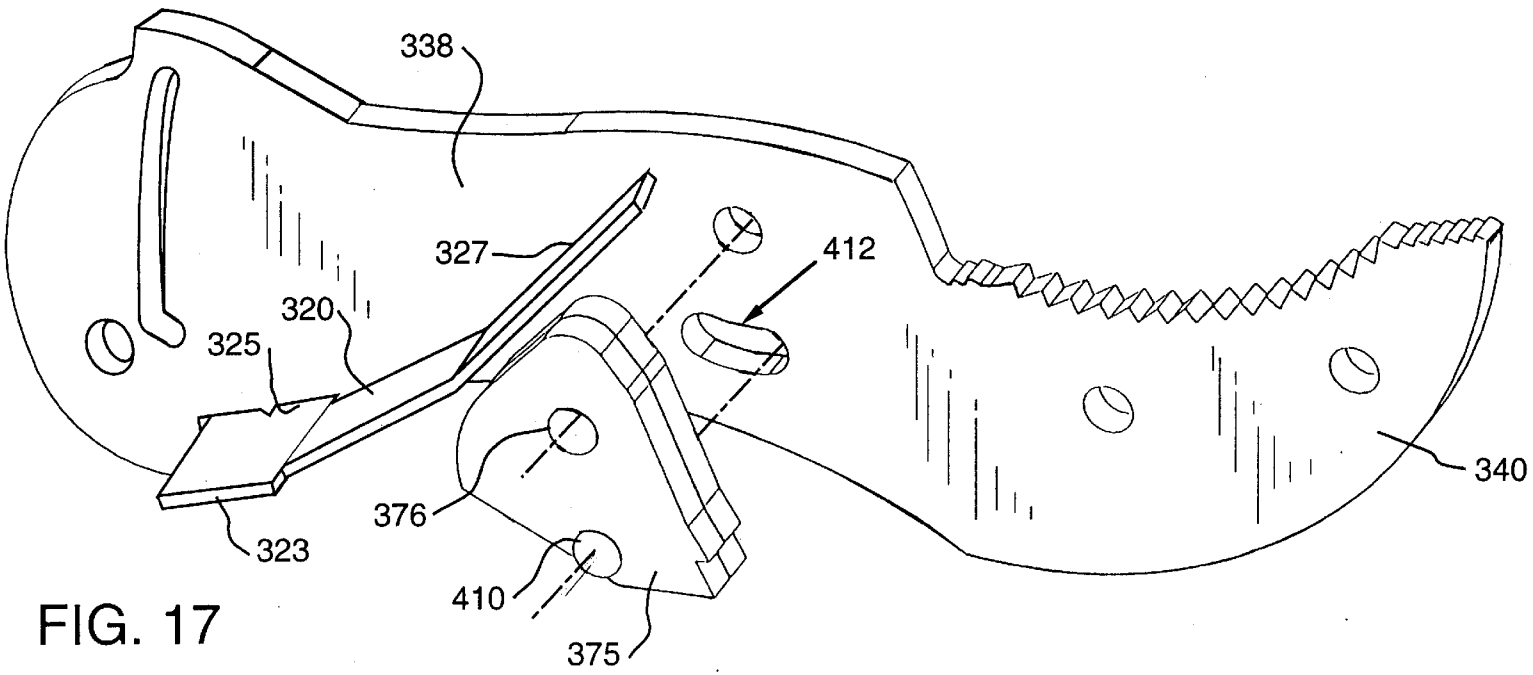
FIG. 17 is an exploded detail view of an alternate embodiment having a pawl with an integral stop pin.

As shown in FIG. 17, in another preferred embodiment, a pawl stop pin 410 is incorporated into the pawl 375 and a corresponding arc-shaped clearance slot 412 centered on the pawl pivot pin 376, is provided in the outer laminations of intermediate portion 344 of the first plier member. The clearance slot 412 is sized to prevent pawl 375 from rotating about pawl pivot pin 376 and into engagement with rack 378 (shown in FIG. 11) in Stage 1 while allowing pawl 375 to enter into soft engagement with rack 378 in Stage 2 and Stage 3 (FIG. 12). The clearance slot 412 is also sized to allow pawl 375 to rotate about pivot pin 376 while pawl 375 is engaged with rack 378 (shown in FIG. 14) in Stage 4. That is, the end points of the arc-shaped slot 412 are positioned such that the pawl stop pin 410 is in contact with one edge of the slot 412 when the pliers 330 are in Stage 1 and out of contact with both edges of the slot 412 when the pliers 330 are in Stage 4. Thus, the slot 410 is shaped to (a) position the pawl 375 in concentric relationship to, and out of engagement with, the rack 378 of the second plier member 334 during preparatory handle movement, and (b) prevent pawl stop pin 410 from contacting the other edge of the slot 410 when the handles of the pliers 330 are at the maximum possible range of workpiece compression in Stage 4.

As shown in FIGS. 11–14, the positioning slot portion 372 of the dog-leg slot 370 has a curvature generally centered about the pivot pin 376 which mounts the pawl 375. In addition, the generally arcuate rack 378 has a curvature generally centered about the pivot pin 368. The relative movement of the first plier member 332 and the second plier member 334 against each other are therefore controlled by the precise geometry of defined pivot points and corresponding arcs. This approach allows tight tolerances and precise, predictable and repeatable adjustment in grasping action with minimal looseness in the pliers 330.

The pliers 330 also include a first biasing means, such as leaf spring 348 structured to bias the pivot pin 368 toward the transitional portion 373 of the dog-leg slot 370 as the pivot pin 368 moves from the transitional portion 373 up into the positioning slot portion 372 during the continued movement of the handle portions 336 and 342 toward each other when applying the augmented grasping force to a workpiece. The leaf spring 348 includes a proximal end 348P located adjacent to intermediate portion 338 and a distal end 348D coupled to the second plier member 334. The intermediate portion 338 of the first plier member 336 includes a bearing surface 349 where a proximal end 348P of the leaf spring 348 acts against the bearing surface 349 to bias the pivot pin 368 toward the transitional portion 373 of the dog-leg slot 370. Distal end 348D is attached to a distal end 342D of the handle portion 342 of the second plier member 334 by, for example, tabs 381 formed on the distal end of the leaf spring 348 extending through slots 383 formed in the laminations 360 and 362 which form the handle portion 342 of the second plier member 334. Alternatively, the leaf spring 348 may be attached to the distal end of the handle portion 342 by, for example, pins or rivets (not shown) extending through the handle and the distal end of the leaf spring 348 or other suitable means.

The bearing surface 349 is generally arcuate and has a curvature generally centered about a center point of the pivot pin 368 when the pivot pin 368 is positioned in the transitional portion 373 of the dog-leg slot 370.

A second biasing means, such as generally designated by reference numeral 351, is provided for biasing the handle portions 336 and 342 away from each other and the jaw portions 340 and 346 away from each other to maintain the pliers 330 in Stage 1, the fully open position (FIG. 11), to maintain the pivot pin 368 in the shifting slot portion 374 when pliers 330 are in the Stage 1 fully open position, and to return the pliers 330 to a fully open position following operation of the pliers 330. The second biasing means 351 may, for example include an extension spring 385 attached at one end by a pin 386, or other suitable means, to the handle portion 336 of the first plier member 332. The other end of the spring 385 may include a straight extension of the spring 385 or be hooked to a spring link 387 or other suitable means. The straight extension of spring 385, or the opposing end of the spring link 387 is in turn attached by a pin 389 to the intermediate portion 344 of the second plier member 334. Preferably, the spring link 387 is a rigid member that is constructed and arranged for cooperation with the spring 385 for biasing the handle portions 336 and 342 away from each other and the jaw portions 340 and 346 away from each other. The straightened extension of the spring, or spring link 387 are preferably positioned between the link members 367, 369 and the laminations 354 and 356 which form the handle portion 336 of the first plier member 332. This arrangement allows for operation of the pliers 330 without the biasing means 351 interfering with the operation of the various elements of the pliers 330. In addition, other types of springs located at various locations on the pliers 330 may be provided for performing essentially the same function, as will be recognized by one of ordinary skill in the art.

Referring specifically to FIGS. 11–14, the operation of the pliers 330 will be described in detail. Specifically, FIG. 11 shows the pliers 330 in a fully opened position with the handle portions 336 and 342 being at the farthermost point away from each other and the jaw portions 340 and 346 being at the farthermost point away from each other. As described, the second biasing means 351 serves to maintain the pliers 330 in the fully open position. The pivot pin 368 is positioned in the positioning slot portion 374 while the pliers 330 are in Stage 1. During the preparatory handle movement in Stage 2 the pivot pin 368 is shifted out of the positioning slot portion 374 into the transitional portion 373 against the bias of the second biasing means 351 when the handle portions 336 and 342 are moved toward each other in response to the user holding pliers 330 in his or her hand in preparation of initiating use of the pliers 330 to grasp a workpiece W. The first biasing means 348 acts against the bearing surface 349 to bias the pivot pin 368 toward the transitional portion 373. During the self-adjusting handle movement in Stage 3, wherein the handle portions 336 and 342 move toward each other and the jaw portions 340 and 346 move toward each other while the plies 330 self-adjust to make contact with a workpiece W, the pivot pin 368 acts as the active pivot point of the pliers 330.

As shown in FIG. 13 during Stage 3, the self-adjustment stage of operation defined above, the pivot pin 368 is maintained within transitional portion 373 by hand pressure against the handle portions 336 and 342, and against the bias of first biasing means 348 against bearing surface 349. This causes the intermediate portion 338 and jaw 340 to pivot on pivot pin 368 to self-adjust pliers 330 to the size of a workpiece W.

While the pliers 330 are in Stage 3, the bias of the first biasing means 348 against the bearing surface 349 on the intermediate portion 338 of the first plier member 336 serves to maintain the pawl 375 in soft engagement with the rack 378. Specifically, as long as the pivot pin 368 remains positioned in transitional portion 373, the teeth 377 of pawl 375 are kept in constant contact with the teeth 379 of the rack 738 by the second end 327 of spring 320 acting against the upper pawl surface 321. Continued pressure on handle portions 336 and 342 moves the handles toward each other and urges the pawl 375 to travel in the direction of jaw closure from the fully open jaw position along the rack 378 during the self-adjustment stage of operation. It should be appreciated that, during this movement, the pivot pin 368 remains positioned in transitional portion 373 and continues to act as the active pivot point of the pliers 330. Also, during this movement of pawl 375 over the rack 378, the pawl 375 is free to pivot on pin 376 as the teeth 377 ratchet over the teeth 379 against the bias of pawl spring 320. Advantageously, this ratcheting action produces a desirable clicking sound that evidences proper soft engagement of pawl 375. This ratcheting action also assures that the teeth 377 of the pawl 375 will promptly settle into hard engagement with teeth 379 of rack 378 without binding up when the jaw 340 makes contact with workpiece W, and that continued handle convergence forces the pawl to reverse its direction of travel.

Due to the structure of the coupling 341 and its being pivotally interconnected to the handle portion 336 by pin 343 and also being pivotally interconnected to the intermediate portion 338 by pin 345, movement or angular displacement of handle portion 336 around pivot pin 368 results in the movement or angular displacement of the jaw portion 340. This movement is also accomplished by a proximal end 336P of the handle portion 336 being pivotally interconnected by pin 347 to the intermediate portion 344 of the second plier member 334. It will be appreciated that the angular displacement A during self-adjustment is less than the angular displacement B. During this self-adjustment stage of operation the pivot pin 368 acts as the active pivot of the pliers 330, as described, until jaws 340 and 342 contact the workpiece to begin applying the grasping force on the workpiece W.

Referring to FIG. 14, continued movement in Stage 4 of the handle portion 336, as defined above, toward the handle portion 342 results in augmenting the grasping force being applied to the workpiece W. Specifically, once the jaw portions 340 and 346 initially contact the workpiece W (see FIG. 13), continued convergence of the handle portions 336 and 342 results in the coupling 341 rotating the intermediate portion 338 and the jaw portion 340 of the first plier member 332 around pawl pivot pin 376. The rotation of the intermediate portion 338 first causes the pawl 375 to settle into hard engagement with the rack 378 whereby the teeth 377 of the pawl 375 firmly mesh with the teeth 379 of the rack 378. It should be appreciated that this continued movement of the handle portion 336 toward the handle portion 342 results in the excursion of pivot pin 368 as it moves into positioning slot portion 372 against the bias of the first biasing means 348. The pivot pin 368 will continue to move within positioning slot portion 372 and away from the transitional portion 373 as the handle portion 336 is moved closer to the handle portion 342 during compression of the workpiece W. It should be appreciated that this movement of pivot pin 368 into positioning slot portion 372 occurs to the degree that the jaws compress a workpiece, and that applying an augmented grasping force to a non-compressible workpiece such as a steel bar will result in negligible movement of the pivot pin into the positioning slot.

FIG. 14 shows the handle portion 336 near the end of the operating range for augmenting the grasping force applied to the workpiece W. In addition, jaw portions 340 and 346 are shown applying a high degree of compression to a compressible workpiece W. Following the self-adjusting movement of the handle portion 336 toward the handle portion 342 to self-adjust to the size of the workpiece and to apply a grasping force to the workpiece W (see FIG. 13), the movement or angular of the handle portion 336 results in the movement or angular of jaw portion 340. It will be appreciated that during this compression stage of operation to augment the grasping force applied to the workpiece W the angular displacement C is greater than the angular displacement D.

In operation of the pliers 330 of the invention, it will be appreciated that the first plier member 332 and the second plier member 334 are coupled such that the handle portions 336 and 342 and the jaw portions 340 and 346 converge at different angular rates in order to self-adjust and apply an initial grasping force to a workpiece and at different angular rates to provide for augmenting of the grasping force applied to the workpiece. Initially, the handle portions 336 and 342 need to converge toward each other only slightly in order to cause the jaw portions 340 and 346 to travel very rapidly from Stage 1, the fully open position, through the entire adjustment range from jaws fully open to jaws fully closed in Stage 3, or until the jaw portions 340 and 346 are in engagement with the workpiece and begin applying a grasping force thereto. Next, in Stage 4, the structure of the pliers 330 allows for the rate of convergence of the jaw portions 340 and 346 to be much less than the rate at which the handle portions 336 and 342 converge, thereby providing for augmenting the grasping force applied to the workpiece and magnifying the gripping force of the pliers 330.

As described, one of the essential features of the invention that allows for the various angular rates of convergence between the handle portions 336 and 342 and the jaw portions 340 and 344 is the indirect connection between the handle portion 336 and the intermediate portion 338 provided by the coupling 341. Once the jaw portions 340 and 346 contact the workpiece W and apply the grasping force thereto, continued movement of the handle portion 336 toward the handle portion 342 causes the link members 367 and 369 to rotate the intermediate portion 338 and the jaw portion 340 of the first plier member 332 and augment the grasping force applied to the workpiece W. The amount of force augmentation is determined by the geometry of the pivot points in relation to jaws 340, 346 and transitional portion 373. For example, the angular movement of jaw 340 during Stage 3 when self-adjusting to the size of a workpiece W can be accelerated in relation to the angular movement of the handle 336 by moving the pin 345 which mounts the link members 367 and 369 to the intermediate portion 338 closer to the shifting slot portion 374 of the dog-leg slot 370. However, this will also increase the effort required to move the handle 336 during Stage 3 self-adjustment. It will be appreciated that pin 345 may be located in a link connection area 350 on the first plier intermediate portion 338 defined by a line extending through pin 343 and transitional portion 373 and opposite jaw portion 340.

Figure 18:
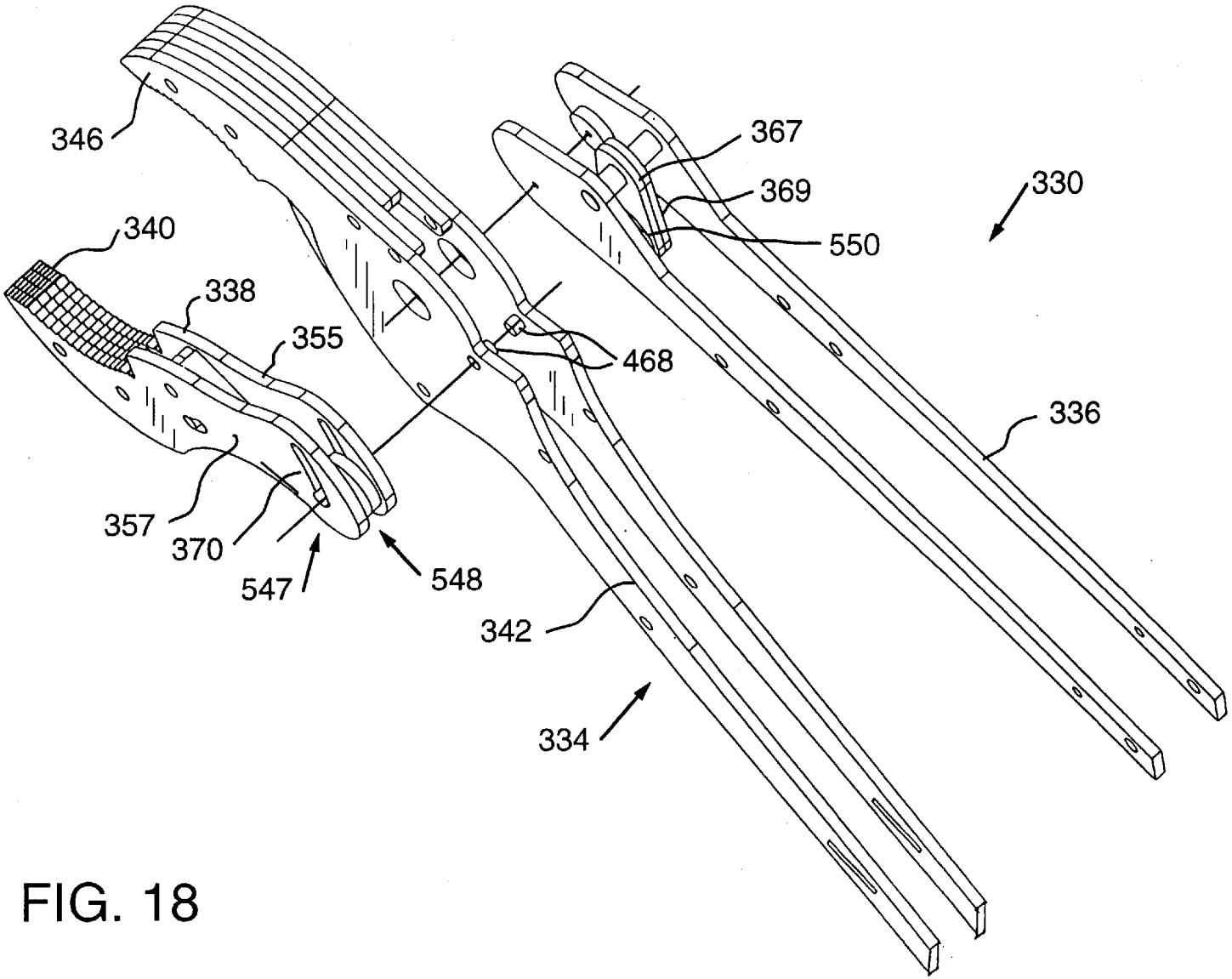
FIG. 18 is an exploded detail view of an another embodiment having protrusions rather than a pivot pin in the first pivot.

In another embodiment, shown in FIG. 18, the pivot member consists of two independent pivot protrusions 468 whose axes are aligned with the axis of the first pivot. The length of pivot protrusions 468 is equal to or shorter than the thickness of the laminations 355 and 357 of the intermediate member 338. Because the short pivot protrusions 468 keep the center laminations unobstructed, the center of rotation of an in-line pivot, such as pivot 345 described below, which mounts link members 367 and 369 to the intermediate member 338 can be in even closer proximity to the center of rotation of the first pivot. The closer proximity of the centers of rotation of the pivot points allows for a further increase in the angular displacement of the jaw member 340 compared to the angular displacement of the handle member 336 during the self-adjusting stage of the operation of pliers 330. Replacing pivot pin 368 by pivot protrusions 468 provides clearance for the link members 367 and 369 which hold pin 345 and eliminates potential interference between the pivot pin 368 and the link members as protrusions 468 cooperate with the dog-leg slot 370 during operations of the pliers 330. Bringing the center of rotation of the first pivot closer to the center of rotation of the pivot 345 by which link members 367, 369 are attached to the intermediate member 338 will accelerate jaw movement in relation to handle movement during the self-adjustment stage, as will be readily apparent to anyone familiar with the art.

Similarly, moving pin 343 which mounts link members 367 and 369 to handle 336 closer to pin 347 which mounts handle 336 to intermediate member 344 tends to decrease movement of the jaw 340 in relation to movement of the handle 336 when applying additional grasping force to the workpiece W to further increase force augmentation. In addition, the length of the link members 367 and 369 and the distance from the second pivot point 376 at which the handle 336 is attached to the intermediate member 344, helps to further determine the degree of force augmentation. Also, the length of the link members 367, 369 helps to determine the degree of handle separation of the fully-opened pliers and the ease of handle operation. Generally, there is a trade off situation where achieving more rapid initial closure of the jaw 340 when initially adjusting the jaw 340 to the size of a workpiece requires less handle movement but also permits a greater amount of force augmentation to be achieved with the greater remaining range of handle movement. Specific applications will benefit from different geometric relationships among the above-mentioned elements.

Figure 19:
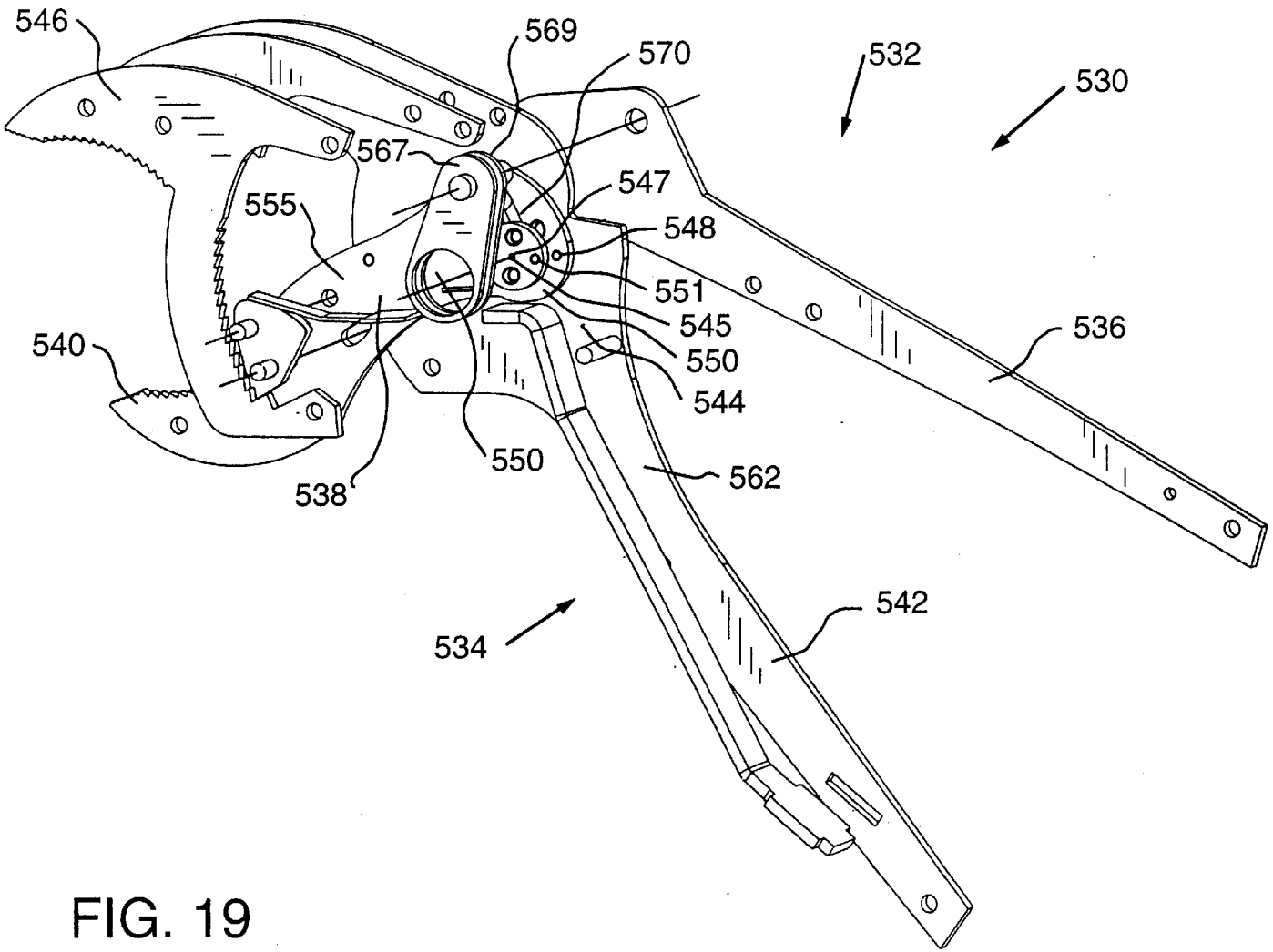
FIG. 19 is an exploded detail view of the pivot connecting the link member to the first plier member intermediate portion utilizing an in-line connection.

An alternate embodiment, shown in FIG. 19, allows for the connection of link members 367, 369 to intermediate member 344 to be located anywhere in link connection area 350, including being immediately adjacent to dog-leg slot 370. It will be understood that the pliers 530 are similar in structure to the pliers 330, as described in detail herein, and that similar components have like reference numbers preceded by a "5". The similarities will be apparent to one of ordinary skill in the art following a review of FIG. 19. In this embodiment, the first plier member 532 includes a handle portion 536, intermediate portion 538 and jaw portion 540. Second plier member 534 includes an integral handle 542, intermediate portion 544 and jaw portion 546. The first plier member handle portion 536 and intermediate portion 538 are coupled to each other by in-line pivot 547 on link members 567, 569. As with the previously described embodiments, the first pivot includes a dog-leg slot 570 formed on intermediate portion 538 and an independent pivot protrusion (not shown) extending from second plier lamination 562 and protruding into dog-leg slot 570. In-line pivots pivotally connects two lamination members within the combined thickness of the lamination members, leaving their external surfaces unobstructed. In-line pivot 547 includes one or more disc-shaped elements 548 which are fixed to the internal faces of laminations 555 and 557 (not shown) of the first plier member intermediate portion 538. An opening 550 of corresponding-size is cut into link members 567, 569. The disc-shaped element 548 is coupled to opening 550 to form the pivot 547. The disk shaped element 548 and first plier member intermediate portion 538 are coupled by a suitable retaining means such as a rivet 551 or screw (not shown), a retaining ring (not shown), matching tapered and interlocking flanges (not shown), or by any other means readily apparent to one familiar with the art. Thus, in-line pivot 547 allows the lamination members 555, 542 and 569 to freely move on their respective pivots without interference.

Using an in-line pivot, the center of rotation of linkage pivot 547 can be positioned as close to, or as far away from, the center of rotation of intermediate portion 538 as needed where the pivot protrusions 568 (not shown) are positioned in the transitional portion 573 of dog-leg slot 570. Linkage pivot 547 uses a surface-applied disc 548 as in-line pivot member for attaching the link members 567, 569 to the intermediate portion 538. This disk 548 can straddle the dog-leg slot 570 on the inside face of first plier member intermediate portion 538 without obstructing free movement of the pivot protrusion 568 inside the slot 570. The inline pivot 547 enables the dog-leg slot 570 to be widened, and the diameter of the pivot protrusion 568 to be enlarged, without requiring that the respective centers of rotation be positioned too far apart for efficient self-adjustment.

Figure 20:
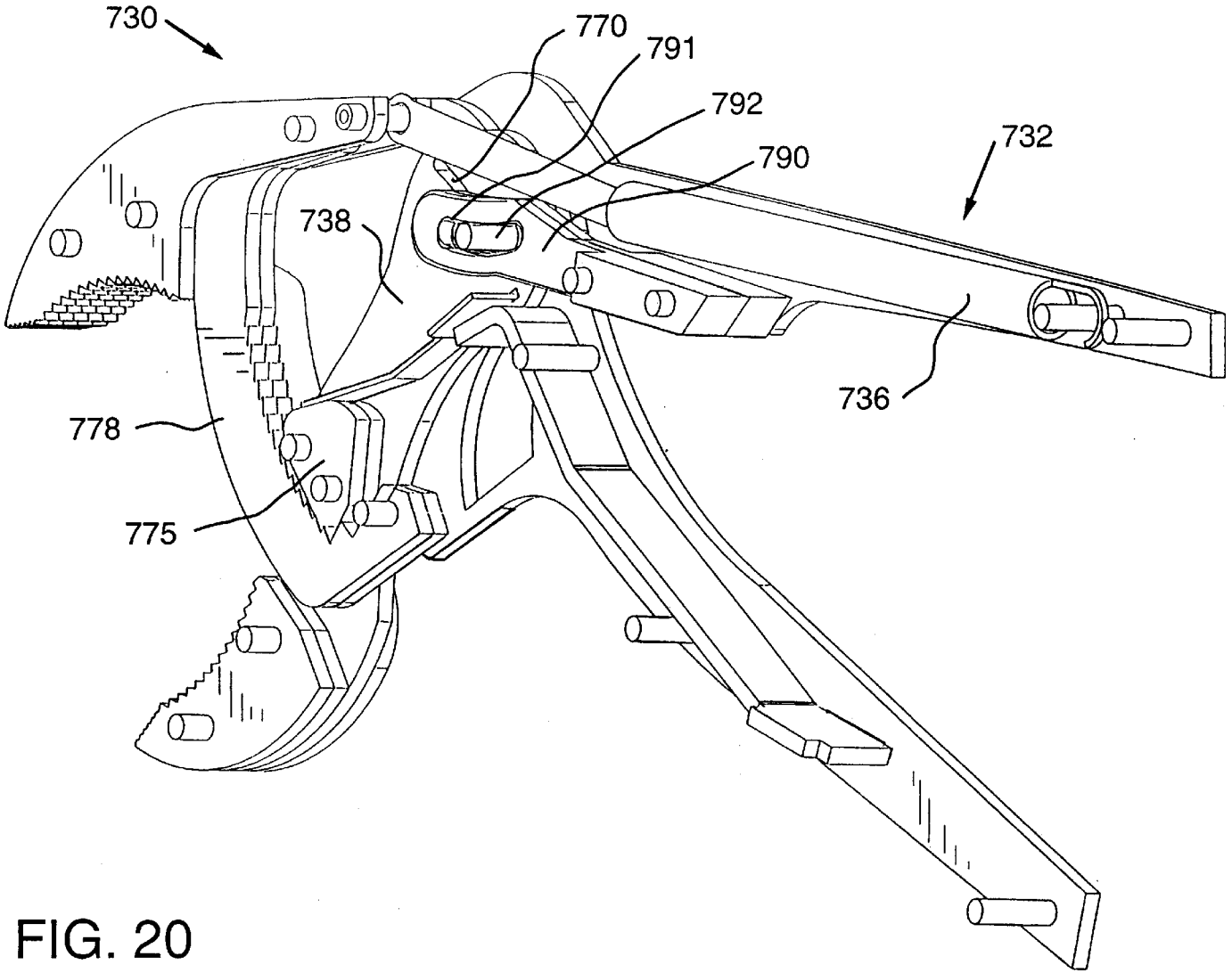
FIG. 20 is another embodiment having a cam and cam follower.

In another preferred embodiment, the coupling 341 between the first plier member handle portion 336 and intermediate portion 338 does not include the link members 367, 369. Instead, the coupling 341 includes a cam means and cam follower means (described below) shown in FIG. 20. It will be understood that the pliers 730 are similar in structure to the pliers 330, as described in detail herein, and that similar components have like reference numbers preceded by a "7". The similarities will be apparent to one of ordinary skill in the art following a review of FIG. 20. For pliers 730, the handle portion 736 of the first plier member 732 is formed separately from the intermediate portion 738 of the first plier member 732. More specifically, the handle portion 736 of the first plier member 732 includes an integrally formed extension 790 which includes cam means, as will be described in more detail herein, for cooperating with cam follower means, which will also be described in more detail herein, formed on the intermediate portion 738 of the first plier member 732. The cam means and the cam follower means cooperate with the first pivot, namely the pivot protrusion 768 which is received in the dog-leg slot 770 (as described in detail herein for the previous embodiment), for applying a grasping force to the workpiece W. The cam means and cam follower means also cooperate with the second pivot means, namely the pawl 775 and the rack 778 (as described herein for the previous embodiment), for augmenting the grasping force applied to the workpiece W.

The cam means includes a cam surface 791 formed on the extension 790 adjacent the intermediate portion 738 of the first plier member 732. The cam follower means includes a cam follower 792 on the intermediate portion 738 positioned generally adjacent the transitional portion 774 of the dog-leg slot 770. The cam surface 791 is positioned for cooperation with the cam follower 792.

As shown in FIG. 15 and as described above, the first biasing means 348 engages the bearing surface 349 formed on the intermediate portion 338 of the first plier member and biases the pivot pin 368 toward transitional portion 373. If the first biasing means is a leaf spring, the leaf spring 348 is structured to have tabs 400 (a tab 400 extending from the opposite side of leaf spring 348 cannot be seen due to the perspective view) disposed on either side of its proximal end 348P come to rest against a spring contact wall 405 of the spring control openings 404. The side tabs 400 cooperate with the spring contact wall 405 to assure that the first pivot will be positioned in and properly aligned with the transitional portion 373 when the bearing surface 349 (FIG. 11) is in contact with the proximal end 348P of the leaf spring 348.

As shown in FIGS. 11–13, the bearing surface 349 is in contact with the leaf spring proximal end 348P, and the tabs 400 are in contact with the spring contact wall 405, during the entire stage of self-adjustment where self-adjusting pressure on the handle portions 336 and 342 causes the jaw portions 340 and 346 to converge on the workpiece W as the jaws self-adjust to the size of the workpiece. As shown in FIG. 14, the bearing surface 349 is in contact with the leaf spring proximal end 348P, and the tabs 400 are out of spring contact wall 405, during the workpiece compression stage where continued pressure on the handle portions 336 and 342 causes the jaw portions 340 and 346 to continue to converge on the workpiece W as the jaws apply augmented grasping force on the workpiece.

As shown in FIG. 11, the bearing surface 349 is out of contact with the proximal end 348P, and the tabs 400 are in contact with spring contact wall 405 when the pliers 330 are in their fully open position before being held by a user in preparation of grasping a workpiece, and also after use of pliers 330. In both instances, before and after use, the second biasing means 351 causes the handle portions 336 and 342 and the jaw portions 340 and 346 to be moved apart to their greatest degree of separation and it also causes the first pivot to be seated in the shifting slot portion 372. During the continued movement of the handle portion 336 toward the handle portion 342 to apply the force augmentation, the leaf spring 348 is deflected as the pivot pin 368 moves from the transitional portion 373 into the positioning slot 372. The leaf spring 348 adds a minimal amount of backpressure against the handle portions 336 and 342. The leaf spring 348 also assists the second biasing means 351 to move the handle portions 336 and 342 and the jaw portions 340 and 346 to the fully open position once hand pressure is removed from the pliers 330.

The tabs 400 of the spring 348, in cooperation with spring contact wall 405, also ensure that the leaf spring returns to the proper position in which it is ready to intercept bearing surface 349 to precisely position pin 368 in the transitional portion 373.

Figure 21:
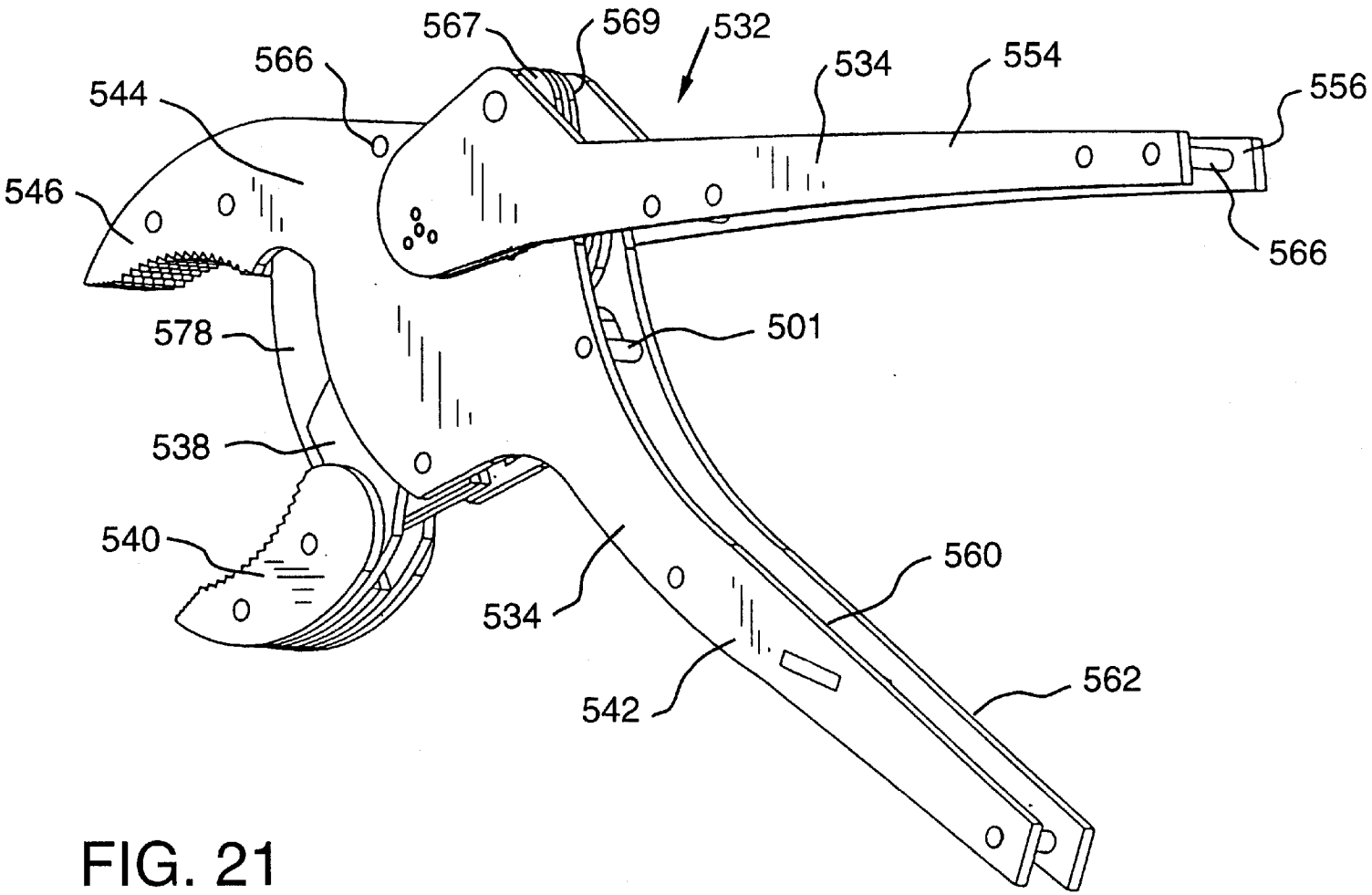
FIG. 21 is a perspective view of another embodiment having an integrated second plier member.
Figure 22:
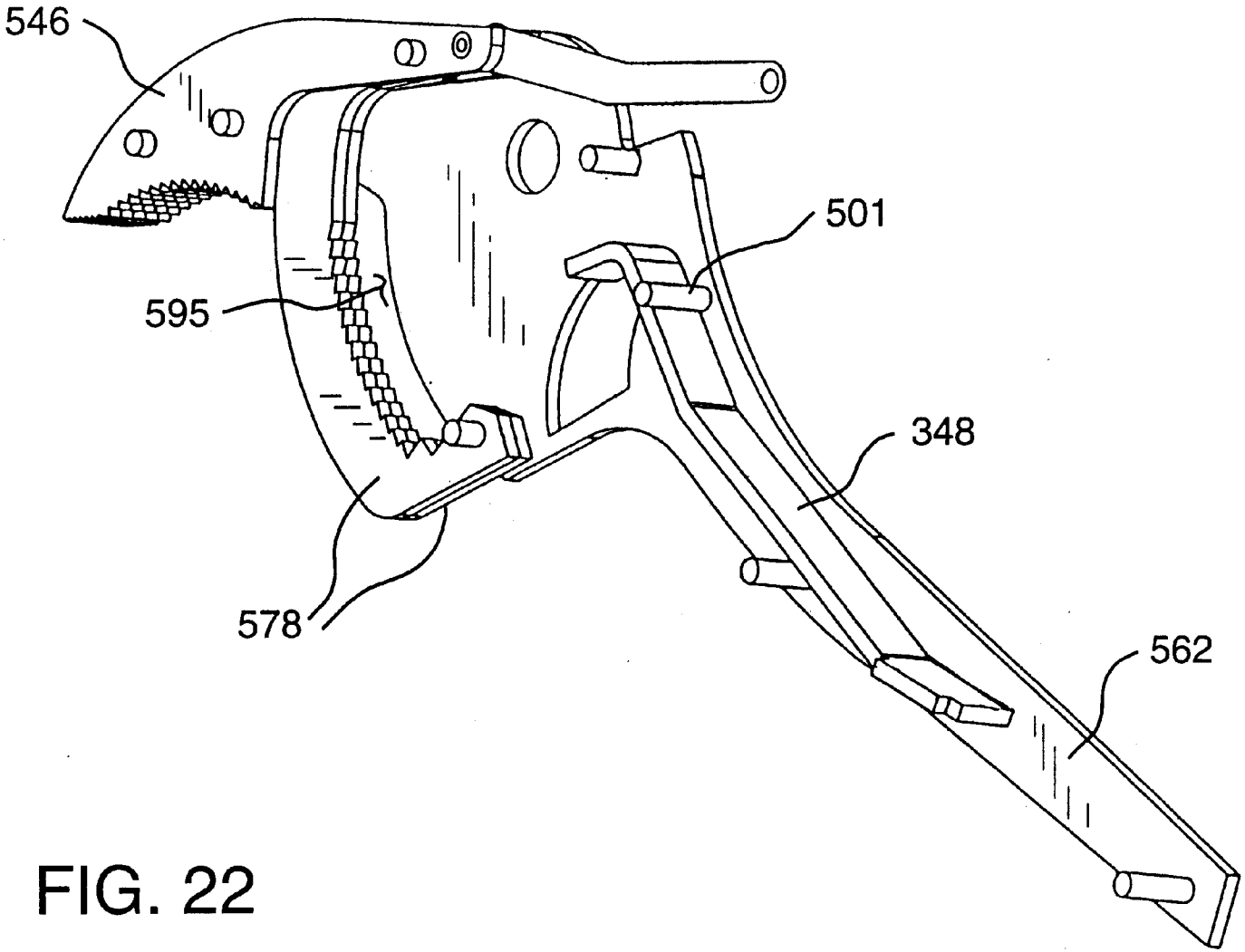
FIG. 22 is a partial perspective view of another embodiment of the second plier member with the top lamination removed.

Another preferred embodiment is shown in FIG. 21 having a second plier member 534 which includes an integral handle portion 542, intermediate portion 544 and jaw portion 546. Generally, this embodiment has an internal configuration similar to the embodiment 330 described above. In this embodiment, the laminations supporting the rack teeth neither contain the first pivot member nor any part of the second plier handle portion 542. Therefore, the rack laminations are contained between the outermost laminations 560, 562 of the second plier member. As shown in FIG. 22, this configuration leaves a suitable opening 595 between the rack 578 and the outer lamination 562 in which the first plier intermediate portion 538 (FIG. 21) is accepted. Advantages of this embodiment include greater rigidity and load-bearing capability, reduced manufacturing costs due to the reduced number of parts as well as ease of assembly. Additionally, as seen in FIGS. 21 and 22, tabs 400 on leaf spring 348 as well as control openings 404 have been removed and a single stop pin 501 is disposed between laminations 560 and 562 which form second plier member 534 to position leaf spring 348 for proper alignment of the first pivot means in the transitional portion 373 of dog-leg slot 370.

Whereas particular embodiments of the present invention have been described herein for purposes of illustration, it will be evident to those skilled in the art that numerous variations of the details may be made without departing from the invention as defined in the appended claims.

What is claimed is:

1. Pliers with self-adjustment capability for applying a grasping force to a workpiece and for augmenting the grasping force applied to the workpiece comprising:

a first plier member including a handle portion, a jaw portion, an intermediate portion, a coupling interconnecting the handle portion of said first plier member to the intermediate portion of said first plier member, and locking means;

a second plier member including a handle portion, a jaw portion, an intermediate portion disposed therebetween;

a first pivot including a shifting slot portion, a transitional portion, and a positioning slot portion with a generally arcuate portion formed in said intermediate portion of said first plier member, said first pivot also including at least one pivot member extending into and movable within said shifting slot portion, transitional portion, and positioning slot portion, said first pivot permitting said jaw portions to converge in response to movement of said handle portions toward each other for self-adjusting said jaws to the workpiece and applying said grasping force;

a second pivot defined by said locking means interacting with said second plier member; and a first biasing means for acting in cooperation with (a) said first pivot member for applying the grasping force to the workpiece and (b) said second pivot for augmenting the grasping force applied to the workpiece.

2. The pliers of claim 1 wherein said first plier member includes a rack engaging structure;

said second plier member includes a generally arcuate rack formed on said intermediate portion thereof;

said locking means includes said rack engaging structure of said first plier member and locking surfaces formed on said generally arcuate rack;

said second pivot permitting further convergence of said jaw portions in response to continued movement of said handle portions toward each other for augmenting the grasping force applied to the workpiece;

said rack engaging structure being out of engagement with said locking surfaces of said generally arcuate rack while the pliers are in a fully open position, said rack engaging structure moving into engagement with said locking surfaces of said generally arcuate rack in response to a preparatory movement of said handle portions toward each other prior to the movement of said jaw portions toward each other for applying the grasping force to the workpiece.

3. The pliers of claim 2 wherein said first plier member includes a second biasing means for (a) biasing said at least one pivot member toward said shifting slot portion and (b) biasing said handle portions away from each other and said jaw portions away from each other.

4. The pliers of claim 3 wherein said shifting slot, transitional area, and positioning slot portion are in communication with one another and form a generally dog-leg shaped slot.

5. The pliers of claim 1 wherein said coupling between said first plier member handle portion and said first plier member intermediate portion includes at least one link member having two ends;

said at least one link member pivotally attached at one end to said first plier member handle portion and pivotally attached at its other end to said first plier member intermediate portion.

6. The pliers of claim 5 wherein said link member includes an in-line pivot connecting said one end of said link to said first plier member intermediate portion.

7. The pliers of claim 6 wherein said in-line pivot includes a circular disk disposed on said first plier member intermediate portion in a link connection area; and said link member includes an opening sized to receive said disk;

said link member being pivotally coupled to said first plier member intermediate portion by said disk being disposed within said opening.

8. The pliers of claim 7 wherein said coupling is structured such that angular displacement of said handle portion of said first plier member is smaller than angular displacement of said jaw portion of said first plier member during said self-adjusting movement of said jaw portions toward each other and angular displacement of said handle portion of said first plier member is larger than angular displacement of said jaw portion of said first plier member to permit the augmenting of the grasping force during said continued movement of said jaw portions toward each other.

9. The pliers of claim 1 wherein said coupling between said first plier member handle portion and said first plier member intermediate portion includes:

a cam surface formed on said first plier member handle portion;

a cam follower disposed on the first plier member intermediate portion, positioned generally adjacent the transitional portion;

said cam surface positioned to cooperation with said cam follower for applying said grasping force to the workpiece.

10. The pliers of claim 2 wherein said first biasing means includes a leaf spring having a distal end and a proximal end, said leaf spring distal end attached to said second plier member;

said rack engaging structure being out of engagement with said locking surfaces of said generally arcuate rack while the pliers are in a fully open position, said rack engaging structure moving into engagement with said locking surfaces of said generally arcuate rack in response to a preparatory movement of said handle portions toward each other prior to the movement of said jaw portions toward each other for applying the grasping force to the workpiece; and said intermediate portion of said first plier member includes a bearing surface, said proximal end of said leaf spring spaced from said bearing surface while the pliers are in said fully open position, said proximal end of said leaf spring acting against said bearing surface following said preparatory movement of said handle portions toward each other.

11. The pliers of claim 10 wherein said leaf spring distal end is attached to said handle portion of said second plier member.

12. The pliers of claim 11 wherein said bearing surface is generally arcuate and has a curvature generally centered about said at least one pivot member when said at least one pivot member is positioned in said transitional portion.

13. The pliers of claim 12 wherein said intermediate portion of said second plier member includes a means for positioning said leaf spring so it cooperates with said bearing surface to align said first pivot in said transitional portion.

14. The pliers of claim 13 wherein said proximal end of said leaf spring is structured to act against said bearing surface during a continued movement of said handle portions toward each other such that said leaf spring is deflected by said bearing surface, resulting in said leaf spring being moved out of engagement with said means for positioning said leaf spring.

15. The pliers of claim 14 wherein said means for positioning said leaf spring so it cooperates with said bearing surface to align said first pivot in said transitional portion is a stop pin.

16. The pliers of claim 13 wherein said means for positioning said leaf spring so it cooperates with said bearing surface to align said first pivot in said transitional portion includes said first plier intermediate portion defining an opening having a spring contact wall; and said proximal end of said leaf spring includes a means for retaining said leaf spring in said opening while the pliers are in said fully open position, during said preparatory movement of said handle portions and during a continued movement of said handle portions.

17. The pliers of claim 16 wherein said means for retaining said leaf spring in said first plier intermediate portion opening includes at least one lateral extension from said leaf spring proximal end extending into said opening such that said lateral extension engages said spring contact wall.

18. The pliers of claim 17 wherein said proximal end of said leaf spring is structured to act against said bearing surface during a continued movement of said handle portions toward each other such that said leaf spring is deflected by said bearing surface, resulting in said means for retaining said leaf spring in said first plier intermediate portion opening being moved out of engagement with said spring contact wall of said first plier intermediate portion opening.

19. The pliers of claim 10 wherein said pivot member is formed on said second plier intermediate portion adjacent said shifting slot portion, transitional portion and positioning slot portion and extending into said shifting slot portion, transitional portion and positioning slot portion.

20. The pliers of claim 19 wherein said at least one pivot member is at least one pin.

21. The pliers of claim 4 wherein said at least one pivot member is biased by said second biasing means toward said shifting slot portion while the pliers are in said fully open position, said at least one pivot member being structured to shift against said bias of said second biasing means to said transitional portion during said preparatory movement of said handle portions toward each other as said rack engaging structure shifts into engagement with said locking surfaces of said generally arcuate rack.

22. The pliers of claim 21 wherein said pivot member is biased by said proximal end of said leaf spring into said transitional portion during said preparatory and handle movement of said handle portions toward each other.

23. The pliers of claim 22 wherein said pivot member moves out of said transitional portion into said positioning slot portion with continued handle movement following engagement of the workpiece.

24. The pliers of claim 4 wherein said first plier member includes a leaf spring disposed adjacent to said rack engaging structure;

said leaf spring biasing said rack engaging structure toward said rack;

said rack engaging structure cooperates with said locking surfaces of said generally arcuate rack during said movement of said handle portions toward each other and during said continued movement of said handle portions toward each other.

25. The pliers of claim 23 wherein said generally arcuate rack comprises at least two laminations, each lamination having teeth; and said teeth are offset relative to each other.

26. The pliers of claim 24 wherein said rack engaging structure includes at least two laminations aligned with said rack at least two laminations;

said leaf spring includes at least two fingers, said at least two fingers aligned with said rack engaging structure laminations.

27. The pliers of claim 1 wherein said handle portion of said first plier member includes a proximal end portion pivotally connected to said second plier member adjacent said intermediate portion of said second plier member.

28. The pliers of claim 1 wherein said first plier member includes laminations of sheet metal.

29. The pliers of claim 28 wherein said first plier sheet metal laminations are sheet metal stampings, cuttings, or blanks.

30. The pliers of claim 1 wherein said second plier member includes laminations of sheet metal.

31. The pliers of claim 30 wherein said second plier sheet metal laminations are sheet metal stampings, cuttings, or blanks.

32. The pliers of claim 4 wherein said rack engaging structure is a pawl rotatably disposed on a pivot pin and having a stop pin;

said first plier member intermediate portion includes an arc-shaped clearance slot; and said clearance slot sized to limit the rotation of said pawl to rotate about said pivot pin so that said pawl does not engage said rack during preparatory handle movement while allowing said pawl to engage said generally arcuate rack during movement of said handle portions toward each other.

33. Pliers with self-adjustment capability for applying a grasping force to a workpiece and for augmenting the grasping force applied to the workpiece comprising:

a first plier member including a plurality of laminations defining a handle portion, a jaw portion, an intermediate portion, a coupling interconnecting the handle portion of said first plier member to the intermediate portion of said first plier member, and locking means;

a second plier member including a plurality of laminations, including two outermost laminations;

said second plier member defining an integral handle portion, an integral jaw portion, and an integral intermediate portion disposed therebetween;

a first pivot including a shifting slot portion, a transitional portion, and a positioning slot portion with a generally arcuate portion formed in said intermediate portion of said first plier member, said first pivot also including at least one pivot member extending into and movable within said shifting slot portion, transitional portion, and positioning slot portion, said first pivot permitting said jaw portions to converge in response to movement of said handle portions toward each other for self-adjusting said jaws to the workpiece and applying said augmented grasping force;

a second pivot defined by said locking means interacting with said second plier member;

a first biasing means for acting in cooperation with (a) said first pivot member for applying the grasping force to the workpiece and (b) said second pivot for augmenting the grasping force applied to the workpiece; and said second plier member outermost laminations spaced to allow said first plier member intermediate portion to be inserted therebetween.

* * * * *